United States Patent [19]

Provence et al.

[11] Patent Number: 4,909,532

[45] Date of Patent: Mar. 20, 1990

[54] CROSS-COUNTRY SKI BINDING

[75] Inventors: Marc Provence; Didier Rousset, both of Annecy; Josiane Dunand, Cran Gevrier, all of France

[73] Assignee: Salomon S.A., Annecy Cedex, France

[21] Appl. No.: 153,457

[22] Filed: Feb. 8, 1988

[30] Foreign Application Priority Data

Feb. 13, 1987 [FR] France ..... 87 01839
Jun. 5, 1987 [FR] France ..... 87 07932

[51] Int. Cl.[4] ..... A63C 9/20
[52] U.S. Cl. ..... 280/615; 280/632
[58] Field of Search ..... 280/614, 615, 611, 631, 280/632

[56] References Cited

U.S. PATENT DOCUMENTS

| | | | |
|---|---|---|---|
| 3,861,700 | 1/1975 | Frediksen | 280/615 |
| 4,382,611 | 5/1983 | Salomon | 280/615 |
| 4,484,762 | 11/1984 | Salomon | 280/615 |
| 4,553,771 | 11/1985 | Bernard et al. | 280/615 |
| 4,562,653 | 1/1986 | Salomon | 280/615 X |
| 4,735,433 | 4/1988 | Corbet et al. | 280/615 |

FOREIGN PATENT DOCUMENTS

| | | |
|---|---|---|
| 0375835 | 9/1984 | Austria . |
| 0095400 | 11/1983 | European Pat. Off. . |
| 0183000 | 9/1985 | European Pat. Off. . |
| 2447731 | 8/1980 | France . |
| 2590803 | 5/1987 | France . |

*Primary Examiner*—Charles A. Marmor
*Assistant Examiner*—Michael Mar
*Attorney, Agent, or Firm*—Sandler & Greenblum

[57] ABSTRACT

A "step-in" binding for cross-country skis. The binding includes a latching element, directly biased into an attachment position, which is pivotably mounted to a stirrup element, which is pivotable mounted to a linkage element, the linkage element being indirectly biased to the attachment position. These three elements are associated with a biasing assembly to create an over-center device to urge the latching element toward the attachment position. The binding can be arranged so that the over-center device is bi-stable to thereby urge the latching element toward a release position. In one form of the invention, the front portion of the ski boot is supported for rotation on a journal surface of the binding which coincides with the axis of rotation of the linkage element to provide a less complex and relatively lightweight assembly.

43 Claims, 8 Drawing Sheets

35
37
4
2
100
101
96
97
114
112
110
108
104
106
103
95
113
111
109
78
92
98
90
102
107
76
94
89
104
77
91
105
99
75
79
73
70
66
60
58
104
71
68
61
93
80
88
57
67
84
55
64
54
63
56
58
29
51
50
59
39
83
81
48
44
80
47
32
45
28
87
26
45
33
22
30
27
16
46
85
38

20
23
21
16
25
17
18

CROSS-COUNTRY SKI BINDING

BACKGROUND OF THE INVENTION

1. Field of the Invention

The present invention relates to a cross-country ski binding, and more particularly, to improvements in a known binding, adapted to ensure the linkage between the cross-country ski boot and a cross-country ski.

2. Background and Material Information

A known cross-country ski binding includes the following components: at least one support element; a linkage element for connecting the front end portion of the ski boot to the support element, the linkage element being pivotably mounted on the support element around a first transverse axis; an abutment to limit the rotation of the linkage element in a first direction, around the first axis, with respect to the support element, in a manner so as to define a preferred angular position of the linkage element with respect to the support element, the first direction being oriented from front to rear above the first axis; a latching element for connecting the front end portion of the boot to the linkage element, the latching element being pivotably mounted on the linkage element around a second transverse axis between two positions, respectively, for attachment and release of the front end portion of the ski boot with respect to the linkage element, movement from the release position to the attachment position occurring by rotation of the latching element in a second direction, around the second axis, with respect to the linkage element, the second direction being oriented from front to rear above the second axis; and an elastic bias device for directly biasing the latching element in the second direction and for indirectly biasing the linkage element in the first direction.

A binding of this type is described in French patent application No. 85 17775 of Dec. 2, 1985, and includes, for directly biasing the latching element and for indirectly biasing the linkage element, an elastically compressible element acting elastically between the linkage element, by means of the latching element, and a corresponding element which is itself journalled on the support element. The corresponding element ensures a guidance of the elastically compressible element, which rests on the latching element by means of a cam path, which makes it possible to reach the latching position or the release position by pivoting of the assembly formed by the corresponding element and the elastically compressible element and sliding the elastically compressible element on the latching element.

This design which directly biases the latching element and indirectly biases the linkage element is disadvantageous for a number of reasons. For example, the elastically compressible element and the corresponding element constitute, above the ski, an assembly which moves with respect to the ski during each extensional movement of the foot, i.e., continuously during cross-country skiing, and has a substantial mass and inertia which unfavorably influences the dynamics of the binding and of the ski in its entirety.

Another disadvantage is that it is necessary to have a very complicated and exacting arrangement with respect to the support of the elastically compressible element on the latching element, so as to be able to bring the latter into the latching position or into the release position by a simple controlled movement, with respect to the ski, of the assembly formed by the corresponding element and the elastically compressible element. This precision can be obtained without difficulty during manufacture, however it nevertheless results in it being delicate and, consequently, costly. Furthermore, this need of great precision renders the binding particularly vulnerable to the consequences of wear which inevitably occur, particularly with respect to the support of the elastically compressible element on the latching element.

SUMMARY OF THE INVENTION

It is an object of the present invention to provide a ski binding which includes a linkage element journalled for rotation around a first axis, the first axis adapted to be fixed relative to a ski; a latching element journalled for rotation on the linkage element around a second axis, between an attachment position in which a front portion of a ski boot is latched to the binding by the latching element, and a release position in which the ski boot is not latched to the binding; a stirrup element journalled for rotation on the linkage element around a third axis; and an energization assembly having a first portion adapted to be operatively associated with the ski and a second portion operatively associated with the stirrup in a direction to thereby urge the latching element toward the attachment position.

In a further aspect of the invention, the energization assembly is operatively associated with the stirrup element to bias the stirrup element for rotation around the third axis.

In a further aspect of the invention, the energization assembly is further operatively associated with the stirrup to bias the stirrup element in a direction to thereby urge the latching element toward the release position According to a further aspect of the invention, the second portion of the energization assembly is journalled to the stirrup element around a fourth axis.

According to a still further aspect of the invention, the third axis is adapted to be spaced from a top surface of the ski by a predetermined distance, and whereby in the attachment position, the fourth axis is adapted to be spaced from the top surface by a distance greater than the predetermined distance.

According to a still further aspect of the invention, in the release position, the fourth axis is adapted to be spaced from the top surface by a distance less than the predetermined distance.

According to a still further aspect of the invention, the latching element further includes a surface which is engaged by a segment of the stirrup element when the latching element is in the attachment position, wherein the surface includes a first portion and a second portion and wherein, when the latching element is in the attachment position, the distance between the segment of the stirrup element and the third axis is greater than the distance between the first portion of the surface and the third axis, but is less than the distance between the second portion of the surface and the third axis.

According to a still further aspect of the invention, when the latching element is in the attachment position, the first portion of the surface of the latching element is adapted to be spaced from a top surface of the ski by a distance less than the distance between the second portion of the surface of the latching element.

According to a still further aspect of the invention, the latching element further includes a beak adapted to be engaged by the front portion of the ski boot, which engagement rotates the latching element toward the attachment position.

According to a still further aspect of the invention, the latching element further includes a projection, the stirrup element further includes a segment adapted to engage the projection as the latching element moves from the attachment position to the release position.

According to a still further aspect of the invention, the stirrup element further includes a flap adapted to be manually engaged to thereby effect engagement of the segment with the projection to thereby move the latching element to the release position.

According to a still further aspect of the invention, the projection is shaped in a manner such that the segment is retained by the latching element as the latching element is moved between the attachment position and the release position.

According to a still further aspect of the invention, the linkage element further includes at least one abutment adapted to limit the rotation of the linkage element in a direction towards the rear of the ski.

According to a still further aspect of the invention, the at least one abutment further includes at least a second abutment adapted to limit rotation of the linkage element in a direction toward the front of the ski.

According to a still further aspect of the invention, the latching element further includes at least one facet which engages at least one respective surface of the linkage element in the release position.

According to a still further aspect of the invention, the binding further includes a support element adapted to be affixed to the ski, wherein the linkage element is journalled on the support element around the first axis.

According to a still further aspect of the invention, the support element further includes a generally inverted U-shape in transverse cross-section and is adapted to overlie a central longitudinal rib of the ski.

According to a still further aspect of the invention, the support element further includes a pair of substantially parallel lateral sides, wherein the first axis intersects each of the sides, wherein the linkage element further includes a pair of wings, whereby the wings are in sliding contact with the pair of sides.

According to a still further aspect of the invention, the linkage element further includes a tongue which extends in a direction away from an upper surface of the ski and is adapted to receive an attachment element projecting from the front portion of the ski boot.

According to a still further aspect of the invention, the tongue further includes a first substantially planar surface and at least one projection offset therefrom which is adapted to engage the attachment element of the ski boot.

According to a still further aspect of the invention, the tongue further includes a second substantially planar downwardly facing inclined surface adapted to engage a complementary upwardly facing inclined surface on the front portion of the ski boot.

According to a still further aspect of the invention, the linkage element further includes a substantially planar upwardly facing inclined surface adapted to engage a complementary downwardly facing inclined surface on the front portion of the ski boot.

According to a still further aspect of the invention, the support element further includes at least one substantially flat lower surface adapted to be affixed to the top surface of the ski.

According to a still further aspect of the invention, the support element further includes at least a first projection to which the linkage element is journalled around the first axis.

According to a still further aspect of the invention, the support element further includes a second projection to which the first portion of the energization assembly is journalled for rotation.

According to a still further aspect of the invention, the first projection includes a journal surface, adapted to engage a complementarily shaped surface of the front portion of the ski boot.

According to a still further aspect of the invention, the complementarily shaped surface of the front portion of the boot has a predetermined axis of curvature and wherein, in the attachment position of the latching element, the first axis is adapted to substantially coincide with the axis of curvature so that, at least during the attachment position, the linkage element and the boot both rotate simultaneously around the first axis and the axis of curvature.

According to a still further aspect of the invention, the binding further includes at least a first roller journalled around the first axis and affixed to the first projection, adapted to engage a complementarily shaped surface of the front portion of the ski boot to thereby permit the ski boot and the linkage element, at least during the attachment position of the latching element, to both rotate about the first axis.

According to a still further aspect of the invention, the latching element includes at least a first beak which projects in a direction such that, as the latching element rotates from the release position to the attachment position, the first beak moves in a direction to engage a respective surface of the front portion of the ski boot to thereby latch the front portion of the ski boot to the ski binding.

According to a still further aspect of the invention, in the attachment position of the latching member, a radial force is exerted through the first beak with respect to the first axis.

According to a still further aspect of the invention, the latching element includes a second beak which projects in a direction such that it is adapted to be engaged by the front portion of the ski boot, which engagement rotates the latching element around the second axis toward the attachment position.

According to a still further aspect of the invention, the binding further includes a guidance assembly adapted to be affixed to the ski and operatively associated with the first portion of the energization assembly.

According to a still further aspect of the invention, the energization assembly further includes at least one connecting member, wherein the first portion and the second portion of the energization assembly includes, respectively, a first portion of the connecting member and a second portion of the connecting member, and wherein the guidance assembly is adapted to be operatively associated with the first portion of the connecting member.

According to a still further aspect of the invention, the at least one connecting member moves horizontally relative to the guidance assembly.

According to a still further aspect of the invention, the at least one connecting member rotates relative to the guidance assembly.

Other characteristics and advantages of the binding according to the invention will become clear from the description below, relating to non-limiting examples of the invention, as well as the annexed drawings which form an integral part of this description.

DETAILED DESCRIPTION OF THE INVENTION

Figure 1:
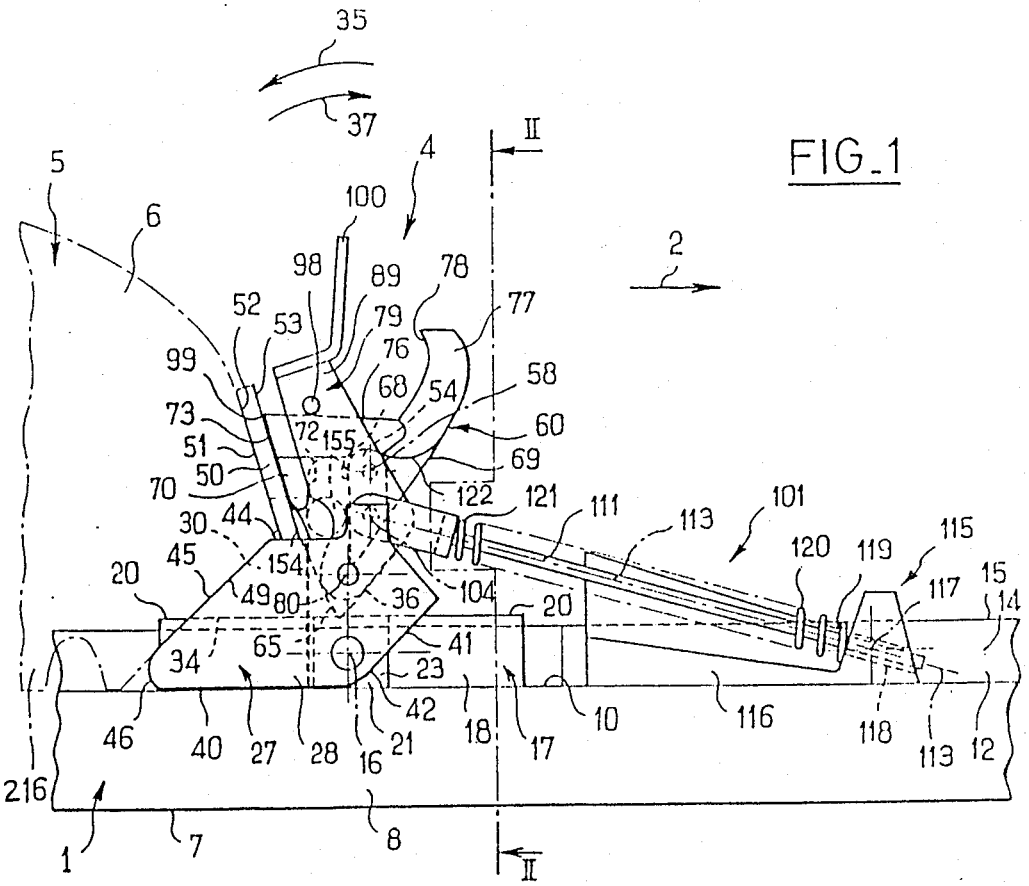
FIG. 1 illustrates, in lateral elevational view, a binding according to a first embodiment of the present invention, wherein the linkage element is in the preferred angular position, in which the boot rests flat on the ski, the latching element is in the attachment position with respect to the front end of the boot with the linkage element, and the stirrup resting on the latching element in the first limit position, wherein the latching element is in the attachment position to retain the front end of the boot with the linkage element and to elastically retain them, by means of the latching element, in the preferred angular position.

An object of the present invention is to overcome the disadvantages of prior art bindings and, to this end, the present invention proposes, in a first embodiment, a binding for a cross-country ski which includes an elastic biasing device. The elastic biasing device includes a stirrup pivotably mounted on the linkage element, around a transverse axis, between a first limit position in which the stirrup rests on a first portion of the latching element in the attachment position, in a direction extending from front to rear above the transverse axis, and a second limit position in which the stirrups rests on a second portion of the latching element in the release position; and an energization assembly for elastically biasing the stirrup in the aforementioned direction, toward the first limit position.

The advantage of the known binding previously described is therefore maintained, i.e., the use of common elastic biasing to both retain the latching element in the attachment position and to ensure the elastic return of the linkage element towards the previously noted preferred angular position, which corresponds in practice to the support of the boot flat on the ski. However, the design of the elastic biasing device, according to the present invention, makes it possible to reduce the mass of the stirrup by reducing the mass of this device which is movable with the linkage element during the rotational movements of the foot. Therefore, in practice, the influence of this elastic bias device on the mass and the inertia of the portions of the binding which are movable with respect to the ski during cross-country skiing is rendered negligible.

Furthermore, the maintenance of the latching element in an attachment position with respect to the front end portion of the boot and the bias of the abutment element towards the preferred angular support position of the boot flat on the ski, results in an elastic biasing of the stirrup in a direction of rotation which does not require great precision with respect to the mutual support of the stirrup and of the latching element, which lends itself to economical manufacture and renders the efficiency of the binding relatively independent of the wear of the binding.

According to one preferred embodiment of the binding according to the present invention, the energization assembly of the stirrup elastically biases the stirrup in a direction opposite to the above-mentioned third direction, toward the second limit position. Thus, by manual action on the stirrup, for example by means of a ski pole, one can bring, at will, the latter to one or the other of the two stable positions, of which one corresponds to the attachment of the boot with the linkage element and of which the other corresponds to the release of the boot.

In a particularly simple manner, the energization assembly of the stirrup preferably includes at least one connecting rod journalled on the stirrup around a fourth transverse axis, a guidance assembly for the connection rod with respect to the ski and, if utilized, with respect to a support element, longitudinal sliding, and for rotation around a fifth transverse axis, and an elastic bias mechanism for the connecting rod for longitudinal sliding with respect to the ski and support element. The positions of the latching element corresponding, respectively, to the attachment and the release of the front portion of the boot are rendered stable, if an arrangement such that the fourth axis defines an elbow joint with fifth and third axes at least in the preferred angular position of the linkage element is adopted to thereby provide an over-center effect.

When the positions of the latching element corresponding, respectively to the attachment and the release of the front portion of the boot constitute stable positions, the binding can easily be provided in which the boot can automatically be inserted into the binding by providing the latching element with a bias portion through the front portion of the boot in the second direction, in the release position. Thus, the natural movement of inserting the boot into the binding causes the bias of the latching element towards the attachment position, and the passage of the latching element to this position under the effect of the elastic biasing device, transmitted by means of the stirrup.

Preferably, even though other arrangements can likewise be adopted, the fourth axis is positioned permanently at a level above that of the first axis and, at least in the first limit position of the stirrup, at a level above that of the third axis. Thus, to obtain the above-mentioned over-center effect, the third axis is positioned permanently at a level above that of the first axis and the fourth axis is situated at an intermediate level between the respective levels of the first and third axes at least in the second limit position of the stirrup.

In a second embodiment, the invention present includes at least one removable journal surface, around the first axis, for the front end portion of the boot with respect to the support element by nesting and removably supporting the front end portion of the boot with respect to the support element in a radial and centripetal direction with respect to the first axis, the removable journal surface projecting forwardly with reference to the radial and centripetal direction and with reference to the second direction; and at least one support surface for the latching element, in the attachment position, on the front end portion of the boot opposite to the first axis with respect to the front end portion of the boot in the radial and centripetal direction, the support surface of the latching element being offset with respect to the second axis and projecting rearwardly with reference to the second direction and being positioned such that it likewise projects rearwardly with respect to the radial and centripetal direction in the attachment position and releases the front end portion of the boot forwardly, with reference to the radial and centripetal direction, in the release position.

The cooperation between the front end portion of the boot, for example, a front projection of the sole of the boot, and the binding, can thus be limited to respectively the surfaces for removable journalling and support, which can ensure good stability of the boot with respect to the binding and to the ski when the latching element occupies its attachment position without requiring a substantial mass. As a result, a binding according to the present invention can be achieved having a small mass, a low weight, and without being complex and costly.

Thus, according to a preferred form of the second embodiment of the invention, the removable journal surface is a surface of the support element, which is at least partially cylindrical along the first axis, which lends itself to a simple design, not very cumbersome, and light. For example, the surface of the support element is convex, to cooperate with a concave surface of the front end portion of the boot and/or the support surface is convex, to cooperate with a concave surface of the front end of the boot, which makes it possible to effectively affix the front end portion of the boot with the linkage element when the latching element is in its attachment position. This configuration permits the binding to be less cumbersome and does not require a mutual complex nesting element, which is heavy and cumbersome.

According to one particularly light form of the second embodiment, but which nevertheless provides every required characteristic of rigidity, the linkage element has the shape of a cap and includes two wings between the first and second axes, such that the front end portion of the boot is engaged between the wings between which are likewise positioned the removable journal surface and the latching element. In this manner, the stirrup is preferably journalled, around a third axis, on the wings of the linkage element.

In FIGS. 1, 2, 7, 8, 9, 11, 12, and 13, there is illustrated a central section of a ski 1 resting flat on a horizontal surface, in a normal position of use. A normal longitudinal direction of displacement of the ski is designated 2, and is horizontal in this example. A longitudinal median plane is designated 3 and is vertical in this example and, with respect to the assembly of the ski 1 as well as to binding 4, provides a longitudinal plane of symmetry. In the following description, the terms "longitudinal", "transverse", "front", and "rear" are to be taken with reference to the longitudinal direction 2 and to the longitudinal median plane 3. Positions relative to horizontal are to be taken with respect to the position of the ski 1 illustrated in FIGS. 1, 2, 7, 8, 9, 11, 12, and 13, and are to be considered indications of relative height, but no limitation with respect to the position in which the binding according to the invention can function is to be inferred.

Figure 7:
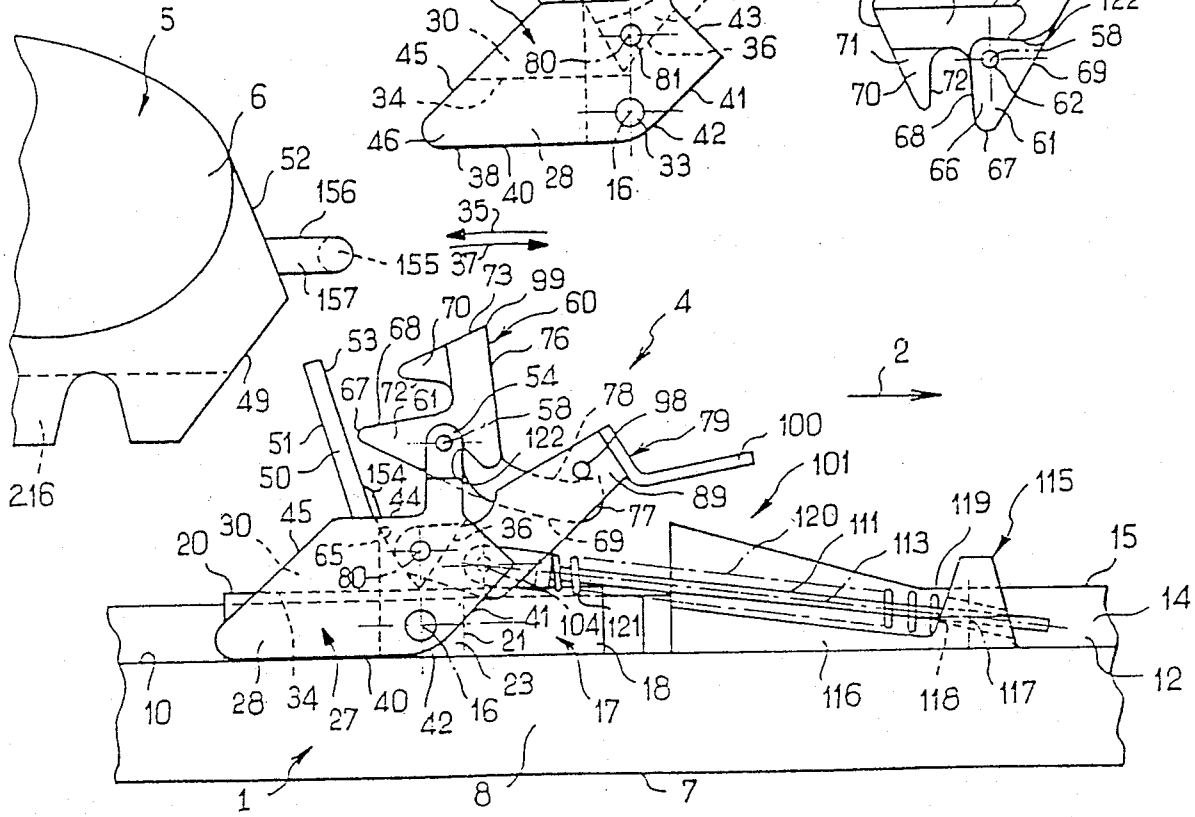
FIG. 7 illustrates one view of the first embodiment of the binding, in lateral elevation, wherein the linkage element occupies the preferred position noted above, and wherein the latching element and the stirrup are in their positions corresponding to the release of the boot; this latter is illustrated in a position preceding insertion of the boot into the binding.
Figure 6:
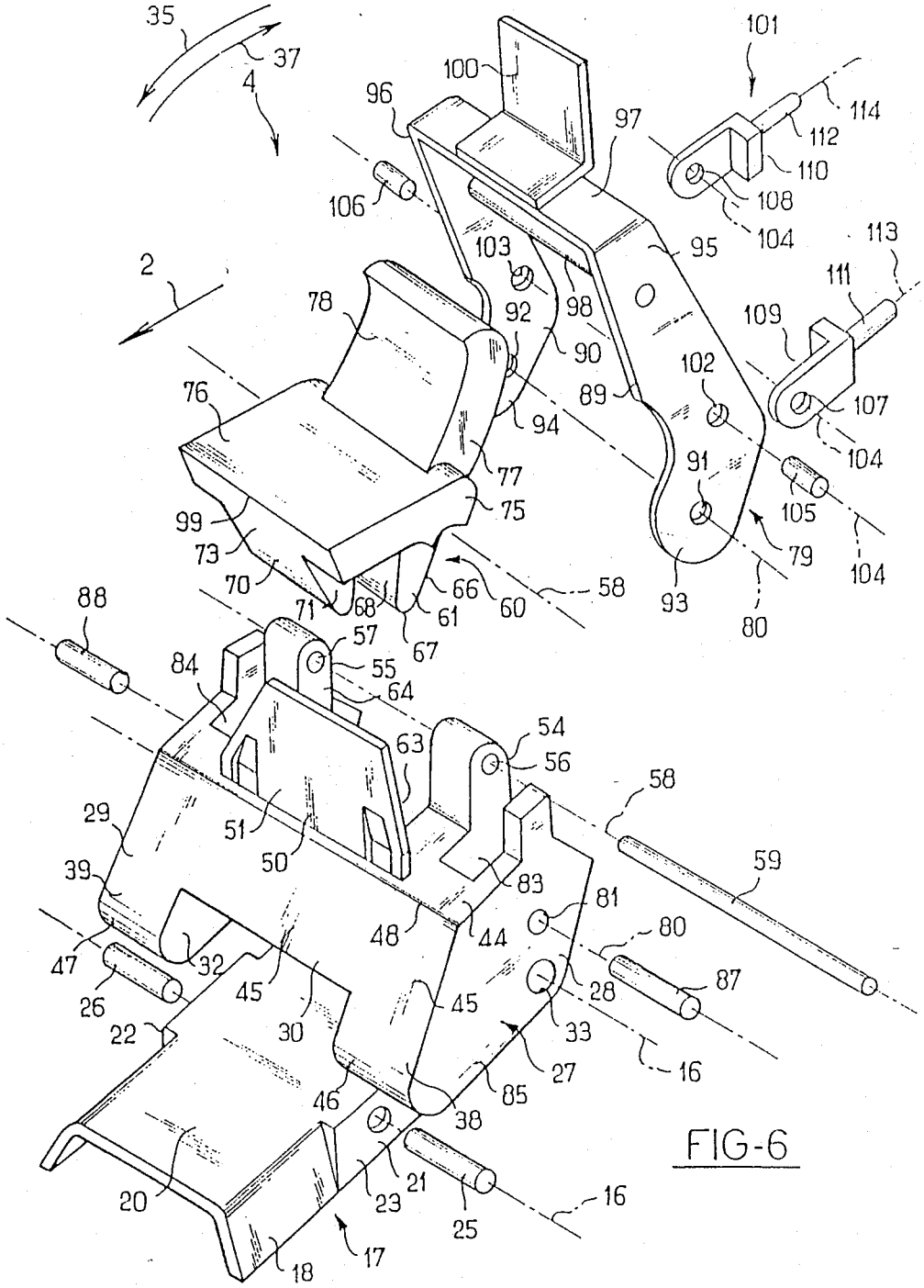
FIG. 6 illustrates, in an exploded perspective view, certain components of the binding in positions corresponding to those of FIGS. 1–5.
Figure 8:
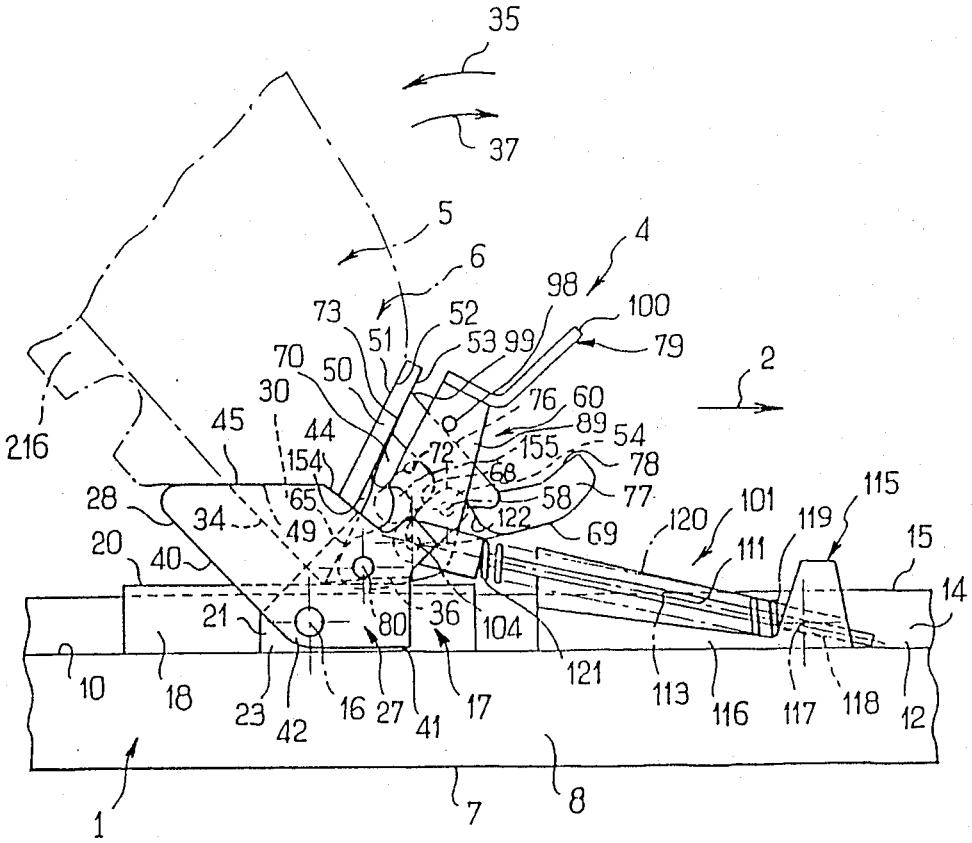
FIG. 8 illustrates, in a view analogous to that of FIGS. 1 and 7, the binding with the boot inserted during the lifting of the heel of the boot, the linkage element occupying an angularly offset position with respect to the preferred position, while the latching element and the stirrup occupy their respective positions corresponding to the attachment of the front end of the boot to the linkage element.

FIGS. 1–8 illustrate a first embodiment of the present invention. In FIGS. 1, 7, 8, a front end portion 6 of a boot 5 is illustrated, which front end portion 6 is connected to the central portion of the ski 1 by means of binding 4 in FIGS. 1 and 8.

In a known manner and by way of non-limiting example, in the illustrated central portion, ski 1 has a lower surface 7 which is substantially planar and horizontal, and is substantially perpendicular to plane 3. The ski further includes two lateral sides 8 and 9 which are substantially planar and vertical, and are symmetrical with one another with respect to plane 3. Sides 8 and 9 connect, upwardly, to two strips 10 and 11 of the upper surface, and are substantially coplanar, horizontal, and symmetrical to one another with respect to the plane 3. As seen, e.g., in FIG. 2, the two strips 10 and 11 are connected to sides 8 and 9 at their outer edges and, at their inner edges, are connected to sides 12 and 13 of a longitudinal rib 14 which forms an integral portion of ski 1, and is placed so as to project above the upper surface of the strips 10 and 11 of the ski. The two surfaces 12 and 13 are substantially planar, symmetrical with respect to the plane 3 and are oblique with respect to the latter, in a manner so as to converge upwardly, where they are connected to an upper surface 15. Upper surface 15 of rib 14 is substantially planar and horizontal, thereby giving rib 14 a trapezoidal cross-section, in the illustrated example. This example is not limiting and one could provide the rib 14 with any other cross-section. Likewise, rib 14 could be separate from, but affixed on ski 1 or, alternatively, could be made integral with ski 1.

In a known manner, rib 14 is adapted to cooperate with a complementary groove 216 provided in a portion of the sole of boot 5, particularly in the front end portion 6 thereof, such that boot 5 occupies the position illustrated in FIG. 1. In this figure, the boot rests flat on the ski, upon strips 10 and 11 of the upper surface on both sides of rib 14 and/or on upper surface 15 thereof and/or on the surfaces of sides 12 and 13 thereof, and wherein groove 216 mates as precisely as possible with rib 14 so as to avoid any possibility of sliding of the boot along a direction perpendicular to the longitudinal median plane 3 of the ski. Such a cooperation of groove 216 with rib 14 must be maintained, more locally, when the heel is lifted from the ski during cross-country skiing, as is shown in FIG. 8, to facilitate the subsequent return to the previously described position illustrated in FIG. 1.

This mode of cooperation of a rib of a ski with a groove of a boot is known to one of ordinary skill in the art, as well as are the characteristics of the shape and dimension, which for this reason will not be further described.

The binding 4, which is adapted to maintain a connection between the front end portion 6 of boot 5 and ski 1, during such relative movements, will now be described. The binding allows exclusively for rotation of boot 5 with respect to ski 1 around a transverse axis 16, i.e., perpendicular to the longitudinal median plane 3 of ski 1. Axis 16 is fixed with respect to ski 1 and with respect to boot 5 and is situated at an intermediate level between that of the upper surface 15 of rib 14 and that of the strips 10 and 11 of the upper surface of ski 1 in a manner so as to intersect rib 14, for example, at mid-height thereof.

To this end, binding 4 comprises, in the non-limiting example illustrated, a support element 17 which is affixed to rib 14 of ski 1, for example, by being screwed on, in a manner not shown, and assumes the form of a rigid, inverted U-shaped plate. Support element 17 mates with surfaces 12, 13 and 15 of rib 14 in a localized portion of the rib by positioning adjacent each of surfaces 12, 13 and 15 a respective parallel planar surface, i.e., a side surface 18, a side surface 19, and an upper surface 20, respectively. The rigid plate 17 furthermore includes two offset portions 21 and 22 which are localized around axis 16 and each of which is defined particularly towards the top by a coplanar extension of surface 20 and, projecting away from plane 3, a respective substantially planar surface 23 and 24, substantially parallel to plane 3, with respect to which the surfaces 23 and 24 are symmetrical, and which are substantially perpendicular and adjacent, respectively, to strips 10 and 11 of the upper surface of the ski.

Slanting respectively above the strips 10 and 11, each of offset portions 21 and 22 carries affixed thereto a respective swivel pin 25, 26 centered around axis 16.

It will be noted that other configurations of surfaces 23 and 24 and swivel pins 25 and 26 with respect to ski 1 can be selected without going beyond the scope of the invention, for example, as a function of a differently shaped rib 14 or of a possible absence of the latter with respect to axis 16.

The two swivel pins 25 and 26 extend laterally substantially to a geometrical coplanar extension of side 8 and to a geometric coplanar extension of side 9, respectively, and ensure the pivotable mounting of a rigid linkage element 27 around axis 16, with respect to support element 17 and with respect to ski 1. Linkage element 27 links the front end portion 6 of boot 5 and ski 1, and will be described more particularly with reference to FIGS. 1, 2, 3 and 6. It is also contemplated that the linkage element could be pivotably mounted directly to the ski without an intervening support element.

In the example illustrated as a first embodiment, linkage element 27 has the shape of a cap which overlaps rib 14 and support element 17. To this end, linkage element 27 includes two wings 28 and 29 of a generally flat shape which are substantially parallel and symmetrical to one another with respect to plane 3. Wings 28 and 29 extend along support element 17 laterally, respectively, on both sides of rib 14, and are connected above support element 17 by means of a body 30, likewise having a generally flat shape with an orientation which is substantially perpendicular to plane 3.

Wings 28 and 29 have respective facing planar surfaces 31 and 32 which are substantially parallel, and symmetrical to each other with respect to plane 3. Surfaces 31 and 32 are spaced apart by a distance which coincides substantially with the distance between the respective surfaces 23 and 24 of the localized offset portions 21 and 22 such that sliding contact is established between surface 31 and surface 23 and between surface 32 and surface 24, respectively. Axis 16 likewise intersects surfaces 31 and 32 in each of which is a bore such as 33 provided in the respective corresponding wing 28, 29. Bore 33 is centered on axis 16 to respectively receive swivel pin 25 or swivel pin 26 and to ensure, by virtue of a complementary shape, the guidance of the linkage element 27 for rotation around axis 16 with respect to support element 17 without relative displacement otherwise.

Between wings 28 and 29, at a level above that of bores 33, the body 30 of the linkage element 27 has, towards the bottom, i.e., facing the upper surface 20 of support element 17, a lower surface 34 which is substantially planar and substantially perpendicular to the longitudinal median plane 3 of ski 1, in an area located to the rear of axis 16 and at a distance from this axis which is substantially the same as the distance between the upper surface 20 of support element 17 and axis 16. In this manner, the lower surface 34 of body 30 can be supported on surface 20 of support element 17 as is illustrated in FIG. 1, to define by such a support a preferred angular position of the linkage element 27 with respect to support element 17, which corresponds to a limit of rotation of linkage element 27 with respect to support element 17 in direction 35, i.e., from front to rear above axis 16.

Towards the front, slightly to the rear of axis 16 in the position illustrated in FIG. 1, lower surface 34 of body 30 is connected to a front surface 36, which surface likewise is positioned between surfaces 31 and 32 of wings 28 and 29, and is likewise substantially perpendicular to the longitudinal median plane 3 of ski 1. Front surface 36 rises towards the front from its connection with surface 34, such that from the position illustrated in FIG. 1, linkage element 27 can pivot in a direction 37 which is opposite to direction 35, around axis 16, with respect to support element 17, and thus can assume another angular position, which is illustrated in FIG. 8, i.e., offset, for example, by approximately 45° in direction 37 with respect to the position illustrated in FIG. 1.

Naturally, wings 28 and 29 have respective sides 38 and 39 whose shape is such that they do not obstruct the rotation of linkage element 27 with respect to support element 17 and with respect to ski 1 between its two angular positions illustrated, respectively, in FIGS. 1 and 8. For example, sides 38 and 39 extend partially cylindrically, along an axis substantially perpendicular to the longitudinal median plane 3 of the ski, and have in front of axis 16 lower respective surfaces such as 40 substantially parallel to the lower surface 34 of body 30, at a level below that of axis 16. Such surfaces 40 rest on the strips 10 and 11 of the upper surface of ski 1 in the position illustrated in FIG. 1. Surfaces 38 and 39 have front respective surfaces such as 41 which are substantially parallel to and in front of surface 36, and in front of axis 16 in the position illustrated in FIG. 1. Surfaces 41 are connected to surfaces 40 by surfaces such as 42, which is partially cylindrical along axis 16. Naturally, other shapes can likewise be adapted for this purpose for sides 38 and 39 without going beyond the scope of the present invention.

Referring to the position illustrated in FIG. 1, surfaces 41 of sides 38 and 39 of wings 28 and 29 are connected at their fronts and tops to the surfaces of the respective sides such as 43 which are likewise substantially planar and substantially perpendicular to the longitudinal median plane 3 of ski 1. These surfaces ascend towards the rear from their connection with surfaces 41, while thus converging upwardly with surface 36 of body 30. Surface 36 and surfaces 43 extend upwardly to a plane containing an upper planar surface 44 of linkage element 27, which is substantially parallel to the lower surface 34 of body 30. Towards the rear, with reference, for example, to FIG. 1, body 30 as well as wings 28 and 29 are connected by planar surface 45 which is substantially perpendicular to the longitudinal median plane of ski 1 and descends towards the rear in the position illustrated in FIG. 1, to rounded edges 46, 47 for connection to surfaces 40 of sides 38 and 39 of wings 28 and 29. Surface 45 extends towards the front to a rectilinear edge 48, which is substantially perpendicular to plane 3, of surface 44.

As shown in FIGS. 1 and 8, rear surface 45 defines the rear of the linkage assembly 27 and is adapted to serve as a support towards the front and bottom, in a known manner, with a surface 49 which is made complementary to the front end 6 of boot 5, in a position where the boot is inserted, which is illustrated in FIGS. 1 and 8.

In a likewise known manner, and so as to cooperate with the front end portion 6 of boot 5 in the position where the boot is inserted in binding 4, the linkage element 27 carries in an affixed manner, projecting above its surface 44 immediately adjacent to edge 48 for linkage with surface 45, a flat tongue 50 which is substantially perpendicular to the longitudinal median plane 3 of ski 1 with respect to which it is symmetrical. Tongue 50 has, for example, a trapezoidal shape, which converges upwardly, when it is seen in a plane perpendicular to the longitudinal median plane 3 of ski 1. It ascends towards the rear, in the position illustrated in FIG. 1, in a manner so as to present towards the rear, above surface 45 of linkage element 27, a substantially planar surface 51 which likewise ascends towards the rear in the position illustrated in FIG. 1, to serve as a support towards the front and top for a surface 52 of boot 5, and which is made complementary to the front end 6 of boot 5, above surface 49.

Towards the front, substantially parallel to surface 51, tongue 50 has a second planar surface 53 which itself has, in the immediate vicinity of the connection of tongue 50 to surface 44 of the linkage element 27, two projections 154 which are symmetrical to one another with respect to the longitudinal median plane 3 of ski 1. Surfaces 49 and 52 of the front end portion 6 of boot 5 are urged against surfaces 45 and 51, respectively, of linkage element 27 by virtue of the cooperation of localized projections 154, and a rectilinear bar 155 which forms the attachment element for the boot 5.

Bar 155 is adapted to be positioned substantially perpendicular to plane 3, and to project forwardly from surface 52, in the form, e.g., of a truncated loop 156 having two arms 157 which are symmetrical to one another with respect to plane 3 and substantially horizontal in the position illustrated in FIG. 1 Arms 157 connect bar 155 to the front end portion 6 of boot 5 and are placed respectively on both sides of tongue 50 in the position in which the boot is inserted to abut laterally on tongue 50 in a manner so as to thus prevent displacement of the boot in a direction perpendicular to the longitudinal median plane 3 of the ski, with respect to linkage element 27.

Projecting above upper surface 44, linkage element 27 has affixed thereto two projections 54 and 55 which are positioned symmetrically to one another and respectively on both sides of the longitudinal median plane 3 of ski 1. The two projections 54 and 55 include respective bores 56 and 57, substantially parallel to axis 16 and situated, in the position illustrated in FIG. 1, at a level above that of axis 16 as well as that of upper surface 44 of linkage element 27, and slightly forwardly of axis 16. Projections 54 and 55 carry the two end portions of a rectilinear shaft 59 within bores 56 and 57, the shaft 59 being positioned along axis 58.

Along a central portion between projections 54 and 55, shaft 59 ensures the swivel mounting, around axis 58, of rigid latching element 60 with respect to linkage element 27. As shown in FIGS. 1 and 8, latching element 60 affixes to linkage element 27 the bar 155 of loop 156 of the attachment element of the front end portion 6 of boot 5. The position illustrated in FIG. 7 depicts the latching element 60 in a position wherein the boot has been removed by release of bar 155 of loop 156 upwardly with respect to linkage element 27, or just prior to the insertion of the boot by engagement of the loop 156 downwardly upon tongue 50.

For reasons of simplicity, latching element 60 will be described essentially in its position where it is affixed to the front end portion 6 of boot 5 and where linkage element 27 occupies, with respect to the ski its angular support position of surface 34 on surface 20 of support element 17, which corresponds to the support of the boot flat on the ski. This position is illustrated in FIG. 1 as well as FIGS. 2, 4, and 6.

With reference to these figures, it can be seen that latching element 60 has, between these two projections 54 and 55, a front beak 61 which has a bore 62 centered around axis 58 which receives shaft 59 and ensures the swivel mounting of latching element 60 with respect to linkage element 27. To receive beak 61 and to allow for rotation of the latching element 60 from the position of attachment of the front end portion 6 of boot 5 with linkage element 27 and the release position of the front end portion 6 of boot 5 with linkage element 27, linkage element 27 includes an opening 63 between projections 54 and 55. Opening 63 is defined on the one hand, by two substantially planar, substantially parallel surfaces such as 64 which are symmetrical with respect to the longitudinal median plane 3 of the ski and, on the other hand, by a surface 65 which is likewise substantially planar, and extends in a substantially coplanar manner from surface 53 of tongue 50 to surface 34, to which surface 65 is connected along edge, substantially perpendicular to plane 3 and surface 36.

Beak 61 is particularly defined by two substantially planar surfaces such as 66 which are substantially parallel and symmetrical to one another with respect to the longitudinal median plane 3 of ski 1. Surfaces 66 are supported between respective surfaces 64 to thus prevent lateral displacement of latching element 60 with respect to linkage element 27. Front beak 61 has an end 67 which extends substantially radially with respect to axis 58, and downwardly in the position illustrated in FIGS. 1, 2 and 4. In the release position illustrated in FIG. 7, end 67 projects in the immediate vicinity of surface 53 of tongue 50, and, more precisely, is spaced from surface 53 distance less than the width of truncated bar 155 of loop 156 of front end portion 6 of boot 5. This dimensional characteristic must likewise be maintained for orientations of the latching element 60, with respect to linkage element 27, close to the release orientation of the boot illustrated in FIG. 7.

Figure 2:
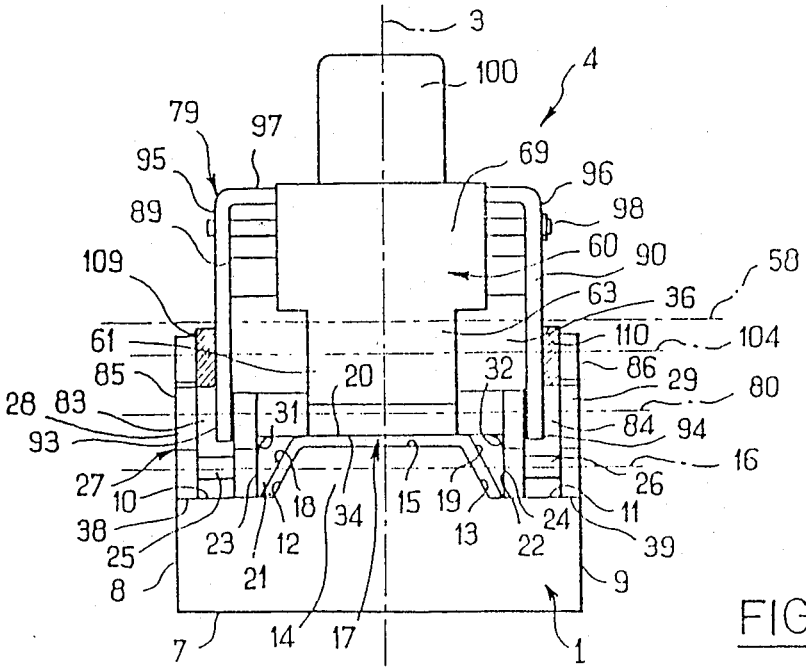
FIG. 2 illustrates a transverse cross-sectional view through a line II—II of FIG. 1.
Figure 4:
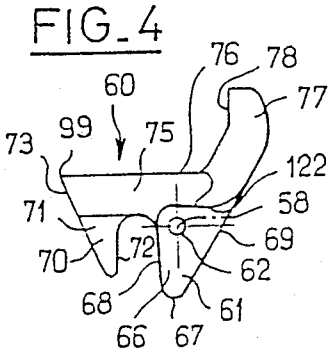
Figure 3:
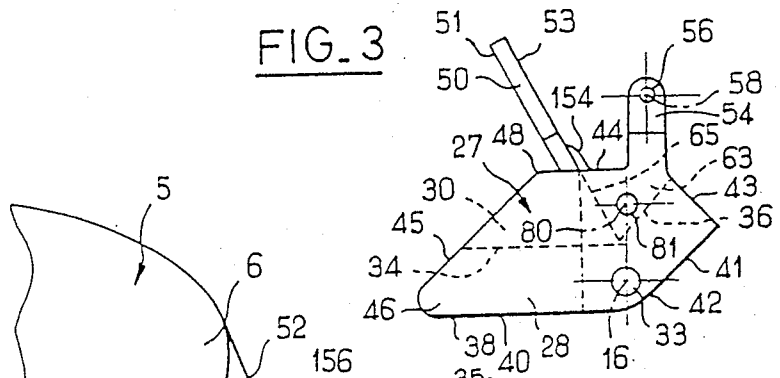

Towards the rear, in the position illustrated in FIGS. 1, 2, 4, front beak 61 of the latching element 60 includes a generally vertical, substantially planar surface 68 which, in the position illustrated in FIG. 7, is oriented generally horizontally and, by virtue of the above-mentioned dimensional characteristic of beak 61, extends to the immediate vicinity of surface 53 of tongue 50. Towards the front in the position illustrated in FIGS. 1, 2, 4, beak 61 includes a front surface 69 whose shape is irrelevant as long as it does not interfere with the different movements already described and those which will follow.

To the rear of and spaced from the front beak 61, with reference to the position illustrated in FIGS. 1, 2, and 4, the latching element 60 has affixed thereto a rear beak 70 projecting downwardly, in the position illustrated in FIGS. 1, 2, and 4. Rear beak 70 includes two substantially planar surfaces 71 corresponding to coplanar extensions of the two surfaces 66 of front beak 61, a front surface 72 which is substantially planar and substantially parallel to surface 68, and a rear surface 73 which is likewise substantially planar and substantially perpendicular to the longitudinal median plane 3 of the ski. Rear surface 73 has an orientation such that it it is flattened against surface 53 of tongue 50, partially between projections 154 of tongue 50, in the position where the front end 6 of boot 5 is affixed to linkage element 27, as illustrated in FIGS. 1 and 8.

The vertical extension of rear beak 70, taken in the position illustrated in FIGS. 1, 2, and 4, is such that, on the one hand, it does not obstruct the pivoting movement of latching element 60 with respect to linkage element 27, which was previously described, and on the other hand, it fits between the bar 155 of loop 156 of front end portion 6 of boot 5 to apply to bar 155 a forward traction, in a manner so as to forcefully press surfaces 49 and 52 of front end portion 6 of boot 5 against surfaces 45 and 51 of linkage element 27 and of tongue 50, respectively, in the attachment position illustrated in FIGS. 1 and 8.

Above the two beaks 61 and 70, with reference to the position illustrated in FIGS. 1, 2, and 4, latching element 60 has the shape of a generally horizontal plate 75 and has, in particular in this position, an upper surface 76 which is generally planar and generally horizontal and extends forwardly from its junction 99 with surface 73, to its connection with a flap 77 which extends upwardly, above upper surface 76, from the front beak 61 of latching element 60. Towards the front, flap 77 is defined by an extension of surface 69, whose shape is irrelevant as long as it does not interfere with the movements which have previously been described or which will be described below. Towards the rear, with reference to the position illustrated in FIGS. 1, 2 and 4, flap 77 is defined by a concave surface 78 which extends substantially perpendicular to longitudinal median plane 3 of ski 1. In the position illustrated in FIG. 7, surface 76 extends generally vertically while flap 77, particularly through its surface 78, extends generally horizontally.

Figure 5:
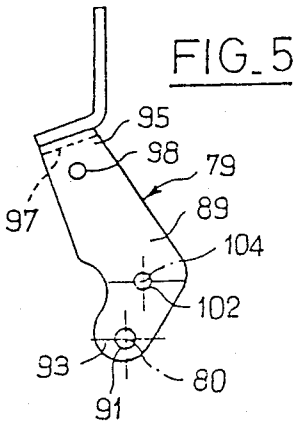
FIGS. 3, 4, and 5 illustrate in the same position as FIG. 1, respectively, the linkage element, the latching element and the stirrup of the binding according to the first embodiment of the invention.

In addition to latching element 60, linkage element 27 has journalled to it a stirrup 79, which will be described more particularly with reference to the position illustrated in FIGS. 1, 2, and 5.

To this end, along an axis 80, which is positioned between axes 16 and 58, particularly in the position illustrated in these figures, and, for example, directly above axis 16, linkage element 27 has two bores such as 81. Each bore extends on opposite sides of a respective notch 83 and 84 provided in linkage element 27. Each of the notches 83 and 84 open towards the front and top in surfaces 41, 43 and 44 of linkage element 27. More particularly, each of the notches 83 and 84 is positioned between a respective one of projections 54 and 55 and respective surface 85, 86, which are substantially planar and substantially parallel to the longitudinal median plane 3 of the ski.

For each of the bores such as 81, the linkage element 27 receives in an affixed manner a respective swivel pin 87, 88, adapted to ensure the swivel mounting of stirrup 79 on linkage element 27.

To this end, stirrup 79 includes two arms 89 and 90 which are substantially planar, substantially parallel, and symmetrical with respect to the longitudinal median plane 3 of the ski and spaced apart by a distance such that each one can engage, through a respective end 93, 94, in respective ones of the notches 83, 84. At its respective end 93, 94, each of arms 89 and 90 includes a respective bore 91, 92 along axis 80, to receive respective ones of swivel pins 87 and 88 and to thus ensure the swivel mounting of stirrup 79 on linkage element 27.

The two arms 89 and 90 have respective second ends 95, 96 through which they are connected by transverse plate member 97, which is substantially perpendicular to the longitudinal median plane 3 of ski 1. Between transverse member 97 and bores 91 and 92, arms 89 and 90 are likewise rigidly connected by a rectilinear reinforcement pin 98, which is likewise substantially perpendicular to the longitudinal median plane 3 of ski 1.

The distance between the reinforcement pin 98 and axis 80 and the shape of arms 89 and 90 of stirrup 79 are such that the stirrup can occupy the position illustrated in FIGS. 1, 2 and 8 in which the stirrup 79 is supported by the reinforcement pin 98 on the upper surface 76 of latching element 60 during the attachment position of the front end portion 6 of boot 5 with linkage element 27. Support is provided in a rearward direction above axes 58 and 80 such that stirrup 79 maintains the latching element 60, resting through its surface 73, against surface 53 of tongue 50. To this end, the distance between reinforcement pin 98 and axis 80 is greater than the distance separating surface 76 and axis 80 when latching element 60 occupies the attachment position illustrated in FIGS. 1 and 8, but the distance between the reinforcement pin 98 and axis 80 is less than the distance between axis 80 the rectilinear edge 99 of the junction between upper surface 76 of latching element 60 and rear surface 73 thereof. Thus, in the position illustrated in FIG. 1, upper surface 76, passing between reinforcement pin 98 and axis 80, ascends towards the rear.

The distance between reinforcement pin 98 and axis 80 and the shape of arms 89 and 90 of stirrup 79 are, furthermore, such that, by rotation of stirrup 79 around axis 80 in a forward direction above axis 80 and rotation of latching element 60 likewise in the forward direction above axis 58, stirrup 79 and latching element 60 can be brought into the position illustrated in FIG. 7, in which stirrup 79 rests through reinforcement pin 98 against surface 78 of flap 77 of latching element 60.

Movement in this direction can be caused at will, by manual action on stirrup 79, for example, by the force of a ski pole applied in this direction on a flap 100 of transverse member 97.

Stirrup 79 is, furthermore, biased elastically by energization assembly 101 of which one preferred embodiment will now be described.

Energization assembly 101 is pivotably connected to stirrup 79 at arms 89 and 90, by two swivel pins 105 and 106, along axis 104, within bores 102 and 103. Axis 104 is substantially parallel to, positioned above, and forward of axis 80 in the position illustrated in FIG. 1, as well as in the position illustrated in FIG. 8, in which stirrup 79 and latching elements 60 occupy the same positions as in FIG. 1 with respect to linkage element 27. On the other hand, axis 104 is positioned at an intermediate level between axes 80 and 16, in front of axis 80, in the position illustrated in FIG. 7.

Each of swivel pins 105 and 106 is mounted for relative rotation around axis 104, in a coaxial and respective complementary bore 107, 108, provided in a respective L-shaped connector 109, 110. Each connector 109, 110 has attached thereto a respective rectilinear connecting rod 111, 112, extending in a radial direction 113, 114 with respect to axis 104.

Each of connecting rods 111, and 112 thus forms a longitudinal projection towards the front with respect to respective corresponding respective arms 89, 90 of stirrup 79, preferably by descending towards the front as is illustrated. Alternatively, in a manner not shown, connecting rods 111 and 112 can be positioned substantially horizontally during operation of binding 4.

To retain the connecting rods 111 and 112 in the preferred orientation, a guidance assembly 115 is affixed to ski 1 in front of axis 16. Guidance assembly 115 can be made as a single piece with support element 17, in a manner not shown, or in the form of an element 116 which is independent of support elements 17 but is affixed by any appropriate means, in front of support element 17. Guidance assembly 115 allows for the longitudinal sliding of the connecting rods 111 and 112 with respect to ski 1, but also allows for their rotation with respect to ski 1 around an axis 117 parallel to axis 16 and affixed, or at least substantially affixed, with respect to ski 1. To this end, for example, element 116 has by way of guidance assembly 115, a front portion having a U-shaped overlapping rib 14 of ski 1 and having, respectively on both sides of rib 14, i.e., respectively above the strips 10 and 11 of the upper surface of ski 1, a respective bore such as 118 slidably longitudinally receiving, along respective axes 113, 114, respective connecting rods 111 and 112. Bores 118 allow, through the choice of a cross-section greater than those of connecting rods 111 and 112, a slight relative axial offset of each of connecting rods 111 and 112 to allow for a variation of the inclination of each of the connecting rods 111 and 112 as a function of the position of axis 104 with respect to axis 16. Such an arrangement is easily conceivable to one of skill in the art, and does not require further explanation. It can naturally be replaced by an arrangement, not shown, which relies upon a precise slidable guidance of each connecting rod 111 and 112 in an element rotatably mounted around axis 117 with respect to element 116, axis 117 being rigidly affixed with respect to the latter.

The guidance assembly 115, furthermore, serves as a forward support, with respect to element 116, for respective end portions such as 119 of helicoidal springs such as 120 of which each is positioned coaxially around respective ones of connecting rods 111 and 112 and, furthermore, have a rear end such as 121 resting against the corresponding respective connector 109, 110, in permanent compressional stress between guidance assembly 115 and the respective connector 109 and 110.

The operation of binding 4 of the first embodiment of the invention is as follows. With the binding attached to the boot 5 as illustrated in FIG. 1, i.e., in a position in which stirrup 79 rests via its reinforcement pin 98 on upper surface 76 of linkage element 60 and in which linkage element 27 is supported by lower surface 34 of body 30 on upper surface 20 of support element 17, the binding 4 is in a stable state, by virtue of the action of the springs such as 120 of energization assembly 101 on stirrup 79.

Starting from this position, if linkage element 27 is pivoted in direction 37, spring such as 120, whose compression increases, retains stirrup 79 and latching element 60 in the position shown in FIG. 1 with respect to linkage element 27, as is shown in FIG. 8, wherein the heel (not shown) of boot 5 has been lifted from the surface of ski 1, which, of course, occurs in the course of cross-country skiing. In the position of FIG. 8, springs 120 act on linkage element 27 by means of stirrup 79 and latching element 60, and apply to linkage element 27 a return moment in the direction 35, towards the position illustrated in FIG. 1.

During such rotational movement, axes 113 and 114 of connecting rods 111 and 112, which are substantially radial with respect to axis 104, pass above axes 16 and 80. This configuration is maintained in the limiting pivot position of linkage element 27 in direction 37, illustrated in FIG. 8.

Starting from the position illustrated in FIG. 1, if a force is applied to stirrup 79 against plate 100, which tends to cause stirrup 79 to pivot forwardly around axis 80 with respect to linkage element 27, which is immovable with respect to support element 17 and ski 1, the pivoting of stirrup 79 is translated into an increased compression of springs 120. Springs 120, of course, are biased to bring stirrup 79 into the position illustrated in FIG. 1 and act along axes 113 and 114 of connection rods 111 and 112 positioned above axis 80.

On the other hand, as soon as axes 113 and 114 of the connecting rods 111 and 112 are made to pass below axis 80, the energization assembly 101 elastically biases stirrup 79 towards the position illustrated in FIG. 7, causing movement of latching element 60 towards the position which is likewise illustrated in FIG. 7. In the FIG. 7 position of binding 4, reinforcement pin 98 of stirrup 79, leaves its support towards the rear and bottom of surface 76 of latching element 60, and comes to rest towards the front and bottom against surface 78 of flap 77 of the latching element 60. An appropriate abutment makes possible the position illustrated in FIG. 7 to be a stable position. For example, to this end and in this position, arms 89 and 90 of stirrup 79 abut the interiors of respective connectors 109 and 110 and/or the flap 77 of latching element 60, which forms a projection with respect to the two lateral surfaces such as 66 of the front beak 61 of latching element 60, and are supported towards the rear against front portions of projections 54 and 55 by two facets 122 which are substantially perpendicular to the longitudinal median plane 3 of the ski and extend downwardly, generally horizontally, in the position illustrated in FIGS. 1, 2 and 4.

During insertion of boot 5 into binding 4, a force is applied to either stirrup 79, or to latching element 60, for example, by the bar 155 of loop 156 of front portion 6 of boot 5 downwardly on rear surface 68 of front beak 61, which causes the return of binding 4 to the position illustrated in FIG. 1. In this position, the bar 155 is locked between latching element 60 and linkage element 27, first against the action of energization assembly 101, and then, with the aid of energization assembly 101, as a result of an overcenter effect during crossing of axis 80 by respective axes 113 and 114 of the connecting rods 111 and 112.

Figure 9:
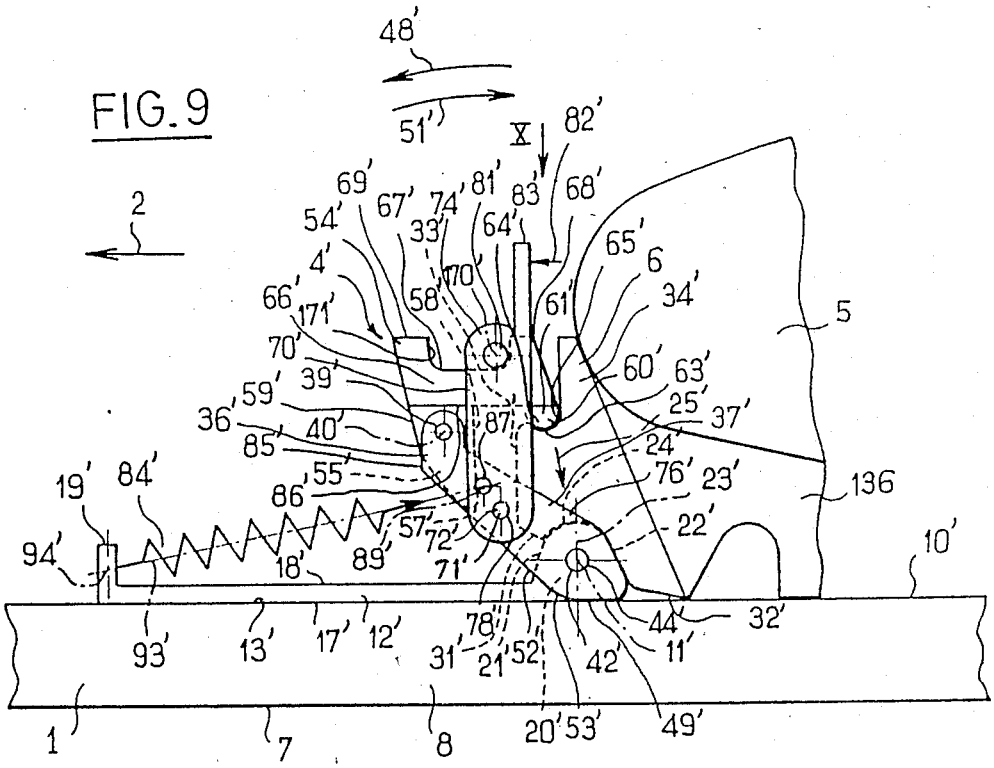
FIG. 9 illustrates, in lateral elevation, a binding according to a second embodiment of the present invention in the state where the boot is inserted, while the linkage element occupies the preferred angular position, in which the boot rests flat on the ski, the latching element is in the attachment position with respect to the front end of the boot with the linkage element, and the stirrup resting on the latching element in the first limit position, wherein the latching element is in the attachment position to retain the front end of the boot with the linkage element and to elastically retain them by means of the latching element, in the preferred angular position.
Figure 10:
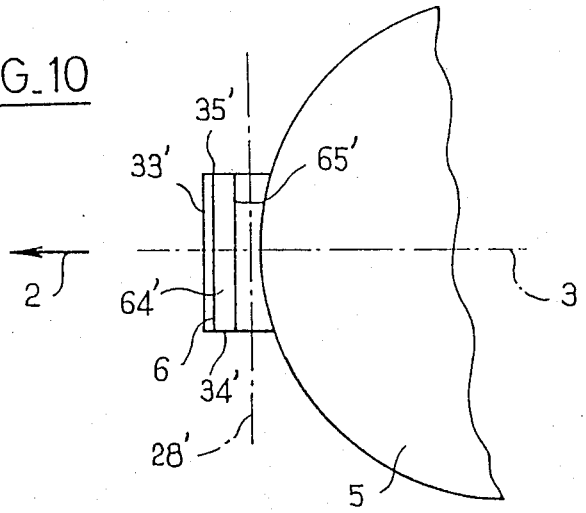
FIG. 10 illustrates, in a plan view, the front end portion of the boot, in the direction indicated by arrow X in FIG. 9.

FIGS. 9–13 illustrate a second embodiment of the present invention. In FIGS. 9, 11, 12, and 13 a central section of a ski 1 is illustrated resting flat on a horizontal surface, in a normal position of use, and in a normal longitudinal direction of displacement 2, this direction being horizontal in this example. In FIG. 10, numeral 3 designates a longitudinal median plane which is vertical in this example, which plane constitutes for the entire ski assembly 1 as for binding 4' a longitudinal plane of symmetry.

Figure 12:
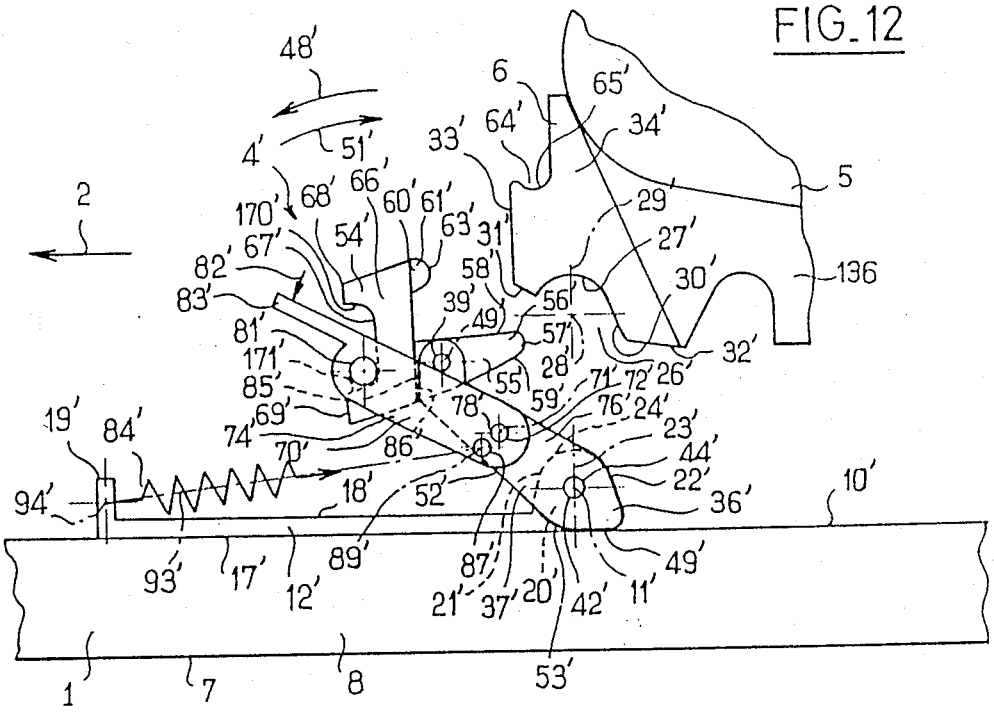
FIG. 12 illustrates a view of the second embodiment of the binding, in lateral elevation, with the linkage element in the preferred position, referred to above, and the latching element and stirrup occupy their positions corresponding to the release of the boot, the latter being illustrated in a position preceding the insertion of the ski boot into the binding.
Figure 13:
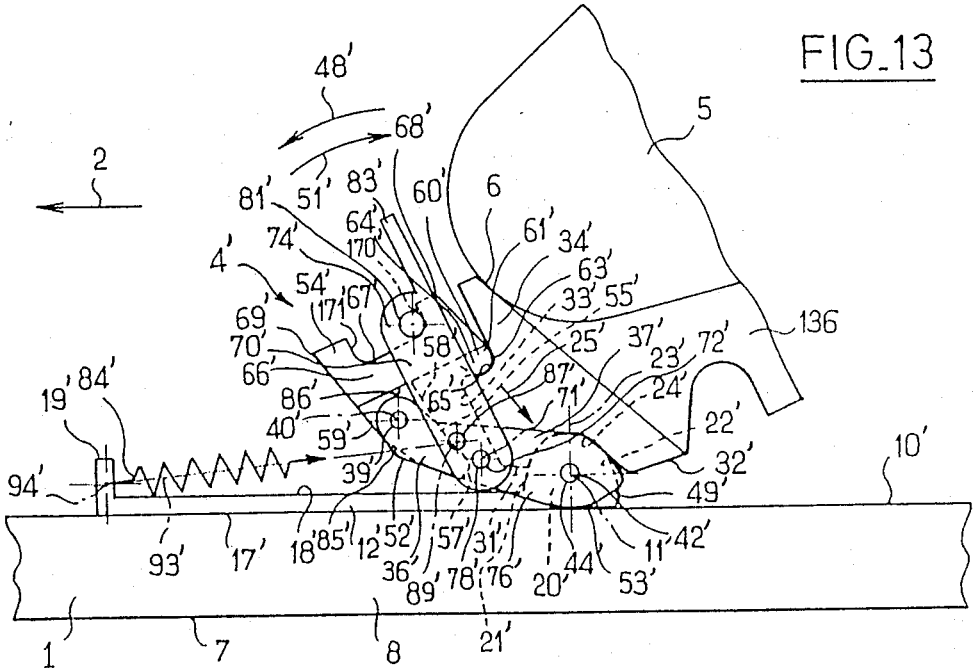
FIG. 13 illustrates, in a view analogous to that of FIGS. 9 and 12, the binding of the second embodiment in the state where the boot is inserted during the lifting of the heel of the boot, the linkage element occupying an angularly offset position with respect to the preferred position, while the latching element and stirrup occupy their respective positions corresponding to the attachment of the front end of the boot with the linking element

In FIGS. 9, 10, 12, and 24 a front end portion 6 of a boot 5 is illustrated, which front end portion 6 is connected to the central section of ski 1 by means of binding 4' as is illustrated in FIGS. 9 and 13.

In a manner described with reference to the embodiment of FIGS. 1–8, ski 1 has a lower surface 7 which is substantially planar and horizontal, and is substantially perpendicular to plane 3. The ski further includes two lateral sides 8 and 9 which are substantially planar and vertical, and are symmetrical to one another with respect to plane 3. Sides 8 and 9 extend toward an upper surface 10', which is substantially planar and horizontal, and perpendicular to plane 3. In the position illustrated in FIG. 9, the boot rests flat on upper surface 10'. Like the embodiment of FIGS. 1–8, upper surface 10' of the ski can have attached thereto a longitudinal rib which is adapted to cooperate with a longitudinal complementary groove provided in a portion of the sole of the boot, particularly in the position illustrated in FIG. 9 and, more locally, when the heel is lifted with respect to the ski during cross-country skiing, for example, in the position illustrated in FIG. 13. The modification of the binding 4' which will be described so as to adapt it to the case where the upper surface 10' of the ski has such a rib, is within the aptitude of one of ordinary skill in the art.

In a known manner, the binding 4' is adapted to maintain a linkage between the front end portion 6 of boot 5 and the ski 1 during lifting of the heel, by allowing rotation of boot 5 with respect to ski 1 exclusively around a transverse axis, 11' i.e., substantially perpendicular to the longitudinal median plane 3 of ski 1, which axis 11' is fixed with respect to ski 1 as with respect to boot 5 and positioned at a level above that of upper surface 10' of ski 1.

To this end, binding 4' comprises, in the non-limiting example illustrated, a support element 12' which is affixed to the upper surface 10' of ski 1, for example by screwing in a manner not shown, and appears, in the disclosed example, in the form of a rigid molded plate resting flat on the upper surface of ski 1. The function of support plate 12' is similar to that of support element 17 of the first embodiment of FIGS. 1–8.

Plate 12, which is symmetrical with respect to longitudinal median plane 3 of the ski, includes substantially planar side surfaces 13' and 14' which are spaced apart a distance less than the distance separating sides 8 and 9 of ski 1 such that there exists two longitudinal strips 15' and 16' of the upper surface 10' of the ski, respectively between the surface of side 13' of plate 12' and the junction of the upper surface 10' of the ski with side 8 thereof, and between the surface of side 14' and the junction of the upper surface 10' of the ski with side 9 thereof.

Between these two side surfaces 13' and 14', the plate 12' has a lower surface 17' which is substantially planar, in flat contact with the upper surface 10' of the ski 1, and an upper surface 18' which is likewise substantially planar and substantially parallel to the lower surface 17'. Upper surface 18' has two projections 19' and 20' which extend upwardly. Projection 19' is located in a front end portion of plate 12', with reference to direction 2, and projection 20' is located in a rear end portion of plate 12', with reference to direction 2. Further, projection 20' surrounds axis 11', referred to above.

Projection 20' includes two planar surfaces 21' and 22' at its front and rear, respectively, which converge upwardly and are positioned substantially parallel to axis 11', symmetrically to one another with respect to a transverse plane 23' which is substantially perpendicular to surfaces 17' and 18' of plate 12' and which includes axis 11'. Above axis 11', the two surfaces 21' and 22' are connected by a convex surface 24' having the shape of a portion of a cylinder around axis 11'.

Surface 24' constitutes, according to the present invention, a journal surface for the front end portion 6 of boot 5 with respect to plate 12', by providing nesting and removable support for the front end portion 6 of boot 5 with respect to plate 12'. This support is provided in a direction 25', which is radial with respect to axis 11, and more precisely, descends towards the rear with reference to direction 2 and as illustrated in FIG. 9 as well as in FIG. 13. Direction 25' is, furthermore, substantially vertical in this example in the position illustrated in FIG. 9. It will be noted that these orientations are not to be in any way considered limiting, i.e., other orientations of direction 25' in the positions illustrated in FIGS. 9 and 13 can be selected without going beyond the scope of the present invention.

Complementary to the projection 20', the front end portion 6 of boot 5 has, toward the bottom, a rectilinear groove 26' which is oriented substantially perpendicularly to the longitudinal median plane 3 of the ski, which groove is defined upwardly by a concave partial cylindrical surface 27' around an axis 28', substantially perpendicular to the longitudinal median plane 3 of the ski and coincident with axis 11' when the boot is in the binding. Surface 27' has a diameter which is substantially the same as that of surface 24' to thereby enable relative sliding movement therebetween, particularly in the direction of a relative rotation around axes 11' and 28', which are then merged. To this end, likewise, with reference to a plane 29' including axis 28', merged with plane 23' in the position illustrated in FIG. 12, the surface 27' has, in front of plane 29', an angular development which is less than the angular development of surface 24' in front of plane 23' while, at the rear of plane 29', it has an angular development which is substantially the same as that of surface 24' at the rear of plane 23'. Surface 27' is connected towards the rear and bottom to a substantially planar surface 30', which occupies, with respect to plane 29', the same position that surface 22' occupies with respect to plane 23', in a manner so as to be applied flat against this surface 22' in the position illustrated in FIG. 9. Furthermore, while surface 30' is connected towards the rear and bottom to a toothed sole surface 32' of boot 5, resting on the upper surface 10' of the ski in the position illustrated in FIG. 9, surface 27' is connected towards the front to a planar surface 31', substantially perpendicular to the longitudinal median plane 3 of the ski and rising toward the front from its connection with surface 27' in the position illustrated in FIG. 9, such that surface 31' does not obstruct the movement of boot 5 to the position illustrated in FIG. 13, by rotation around merged axes 11' and 28' with respect to plate 12' and to the ski 1. In this position, surface 31' is substantially parallel to upper surface 18' of plate 12', while remaining spaced from upper surface 18', although other shapes and arrangements of surface 31' can likewise be utilized.

Towards the front and top, surface 31' is connected to a front end surface 33' of front end portion 6 of boot 5, which surface 33' is, in the example illustrated, substantially planar and substantially perpendicular to the longitudinal median plane 3 of the ski and substantially vertical in the position illustrated in FIG. 9, although other shapes can likewise be utilized. Surfaces 27', 30', and 32', at least in the vicinity of their connection with surfaces 30', 31', and 33' of the front end portion 6 of boot 5, are defined by connection with substantially planar, substantially parallel surfaces 34' and 35', and are symmetrical to one another with respect to the plane 3 and are spaced apart by a distance substantially the same as the distance between the side edge surfaces 13' and 14' of plate 12' as well as projection 20'. Preferably, surfaces 34' and 35' define a front projection of a sole portion 136 of boot 5, which front projection defines the front end portion 6 of boot 5.

It will be noted that it is not beyond the scope of the present invention to ensure by means other than the cooperation between groove 26' and projection 20', the support and nesting of the front end portion 6 of boot 5 in the direction of 25' with respect to plate 12'. In particular, while maintaining groove 26' in the shape which has been described, one could replace projection 20' which is fixed with respect to plate 12', by a swivelling roller 220, as shown in FIG. 11*a*, connected at either end to a respective ear 221, 222 each of which is affixed to plate 12'. Roller 220 has a cylindrical surface around axis 11', with a diameter generally corresponding to that of surface 24'.

One of ordinary skill in the art will likewise easily understand that in the absence of any obstacle, boot 5 can be brought by a simple downward vertical movement towards the upper surface 10' of the ski, by which planes 29' and 23' coincide, in a nesting position of groove 26' on rear projection 20' of plate 12'. This position ensures the journalling around axis 11' of the front end portion 6 of boot 5 towards axis 11' on projection 20' or roller 220. Boot 5 is furthermore released by a reverse movement.

Furthermore, the front end portion 6 of boot 5 rotates around axis 11', on plate 12', by means of rigid linkage element 36', which removably connects the front end portion 6 of boot 5 and ski 1 Linkage element 36' corresponds generally to linkage element 27 of the first embodiment of FIGS. 1–8. It is also contemplated that linkage element 36' could be connected directly to ski 1, without an intervening support plate. In such a case, elements such as 19', 20', 220, 221, and 222 could be otherwise directly attached to the ski.

To this end, plate 21' has affixed thereto respective swivel pins 44', 45' located along axis 11' above the upper surface strips 15' and 16, at its rear projection 20'.

The two swivels pins 44' and 45' extend, respectively, substantially to geometrical extensions which are coplanar with sides 8 and 9 and ensure the swivelled mounting around axis 11', of linkage element 36', which will be described more particularly with reference to FIGS. 9, 11, 12 and 13.

In the example illustrated, linkage element 36' overlies the rear projection 20' of plate 12'. To this end, the linkage element 36' comprises two wings 37' and 38' having a generally flat and elongated shape, which are substantially parallel and symmetrical to one another with respect to plane 3, which wings 37' and 38' laterally extend along projection 20', respectively, on both sides thereof. Wings 37' and 38' are connected above surface 18' of plate 12', in front of projection 20', with reference to direction 2, by means of swivel pins 39' centered on axis 40', substantially perpendicular to plane 3. The two wings 37' and 38' ascend towards the front, with reference to direction 2, in the position illustrated in FIGS. 9, 11, and 12, in which they form an angle on the order of 45° with surface 18' of plate 12'. In the position illustrated in FIG. 13, however, they form an angle less than 45° with surface 18' of plate 12', after rotation of the linkage element 36' around axis 11', with respect to plate 12', in forward direction 48', with reference to the direction 2, above axis 11'.

The two wings 37' and 38' have respective facing surfaces such as 41' which are substantially planar, parallel, and symmetrical to one another with respect to plane 3. Further, these surfaces such as 41' are spaced apart by a distance which coincides substantially with the distance between edge surfaces sides 13' and 14' of plate 12', particularly at the level of projection 20', such that sliding contact is established between the two surfaces such as 41' of wings 37' and 38' and the two side edge surfaces 13' and 14' at the level of projection 20'. Sliding contact is also established between the two surfaces such as 41' of wings 37' and 38' and the surfaces 34' and 35' of the front end portion 6 of boot 5, which is adapted to be partially engaged between wings 37' and 38' in the position illustrated in FIGS. 9 and 13. In each of the surfaces such as 41', a bore 42', 43' is provided in the corresponding respective wing 37', 38', centered on axis 11' to receive the swivel pin 44' or 45', and to ensure, by virtue of a complementary shape, the guidance of the linkage element 36' for rotation around axis 11' with respect to plate 12' without the possibility of relative displacement otherwise.

Naturally, wings 37' and 38' each have respective side edges 46' and 47' whose shape is such that they do not interfere with the rotation of linkage element 36' with respect to plate 12' and with respect to ski 1 between its two angular positions respectively illustrated in FIGS. 9 and 13. For example, side edges 46' and 48' extend partially cylindrically along an axis substantially perpendicular to the longitudinal median plane 3 of the ski, and have to the rear of plane 23', with reference to the position illustrated in FIG. 9, lower respective surfaces 49' and 50' which are substantially planar, coplanar and placed at a level below that of axis 11' such that they rest on the upper surfaces of strips 15' and 16' of ski 1 in the position illustrated in FIG. 9, to thereby define by such a support a preferred angular position of the linkage element 36' with respect to plate 12', corresponding to a limit of rotation of linkage element 36' with respect to plate 12' in a direction 51' opposite to direction 48'.

Towards the front, side edges 46' and 47' have front respective surfaces such as 52', which are substantially planar, coplanar, and which rise towards the front, in the position illustrated in FIG. 9 as well in the position illustrated in FIG. 13, in front of plane 23' in these two positions. These front surfaces such as 52' are connected to the lower surfaces 49' and 50', respectively, by a respective surface such as 53' which is partially cylindrical around axis 11'. Naturally, other shapes can likewise be adopted for this purpose for side edges 46' and 47' without going beyond the scope of the present invention. The shape of side edges 46' and 47' furthermore are irrelevant as long as they do not interfere with the operation of the binding as will be described below.

Between the surfaces such as 41' of wings 37' and 38' of the linkage element 36', a shaft 39' ensures the swivel mounting, around axis 40', of a rigid latching element 54', as illustrated in FIGS. 9, 12, and 13. Latching element 54' corresponds generally to latching element 60 of the first embodiment of FIGS. 1–8. Latching element 54' affixes the front end portion 6 of boot 5 to the linkage element 36', by applying pressure in direction 25' to maintain groove 26' nested, but positioned for relative rotation around axis 11', on rear projection 20' of plate 12'. In the position illustrated in FIG. 12, latching element 54' permits removal of the boot 5, by release of the front end portion 6 of boot 5 in an upward direction, i.e., opposite to direction 25'.

For reasons of simplicity, latching element 54' will be described essentially in its position of attachment to the front end portion 6 of boot 5 and where linkage element 36' occupies, with respect to the ski, its angular support position with the surfaces such as 49' of wings 37' and 38' located on the strips 15' and 16' of the upper surface of ski 1, which corresponds to the support of the boot flat on the ski. This position is illustrated in FIGS. 9 and 11.

It can be seen in these figures that latching element 54' has affixed between two wings 37' and 38' of linkage element 36' a front beak 55' which is bored, along axis 40', to receive the shaft 39' and to thus ensure the swivel mounting of the latching element 54' with respect to linkage element 36'. Beak 55' is defined by two planar surfaces such as 56' (FIG. 12) which are substantially parallel and symmetrical to one another with respect to the longitudinal median plane 3 of ski 1 and have a relative spacing which is substantially the same as that of the surfaces such as 41' of wings 37' and 38' of linkage element 36'. Surfaces 56' are mounted for relative sliding against respective 41' and thus prevent lateral displacement of latching element 54' with respect to linkage element 36'. Towards the bottom and facing surface 18' of plate 12', with regard to the position illustrated in FIGS. 9 and 11, front beak 55' has an end 57' which is sufficiently spaced from surface 18' of plate 12' so as not to hamper the movements of linkage element 36' between its positions, illustrated in FIGS. 9 and 13, respectively. End 57', however, extends substantially radially from axis 40' sufficiently to allow for the automatic insertion of the boot, as will appear below. To this end, this extension is such that in the orientation of the latching element 54' corresponding to the release of the front end portion 6 of boot 5, illustrated in FIG. 12, the end 57' of beak 55' is situated directly above, or nearly directly above, projection 20'.

Figure 11:
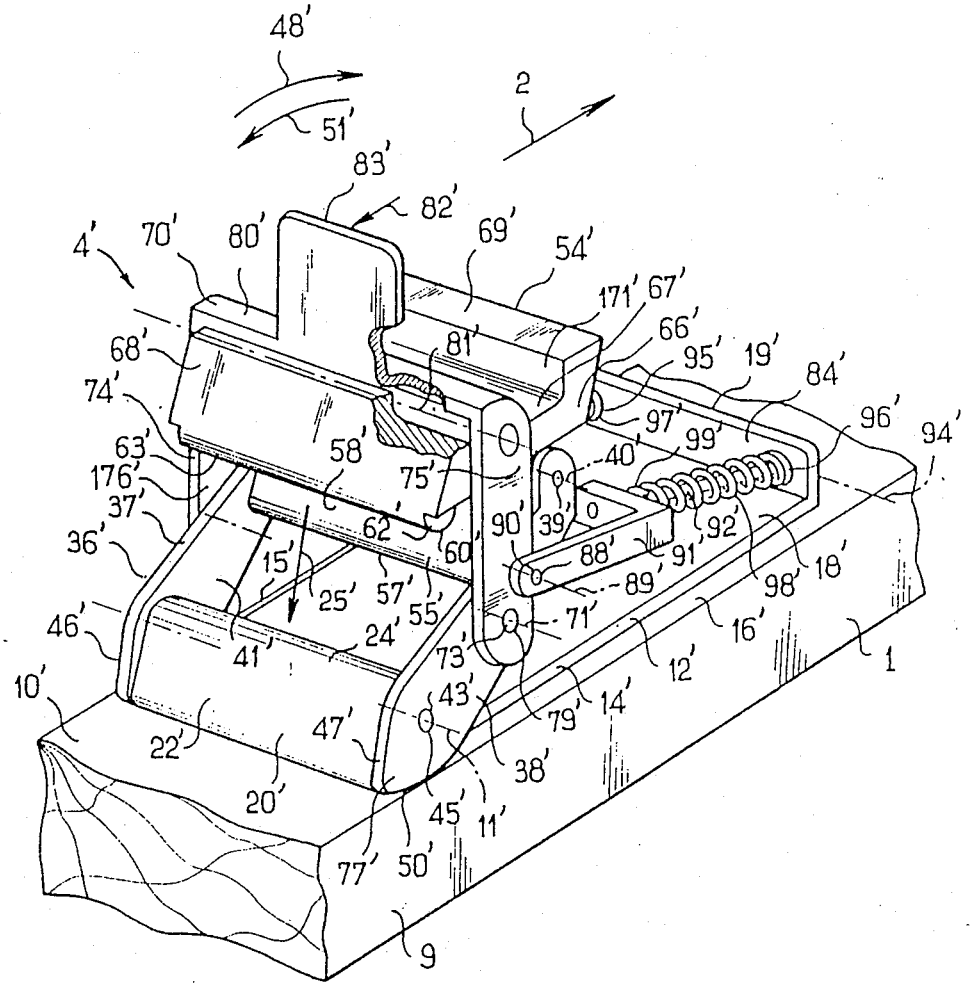
FIG. 11 illustrates, in a perspective view, certain components of the binding according to the second embodiment of the present invention in a direction corresponding to that which they occupy in FIG. 9, but without illustrating the boot.
Figure 11A:
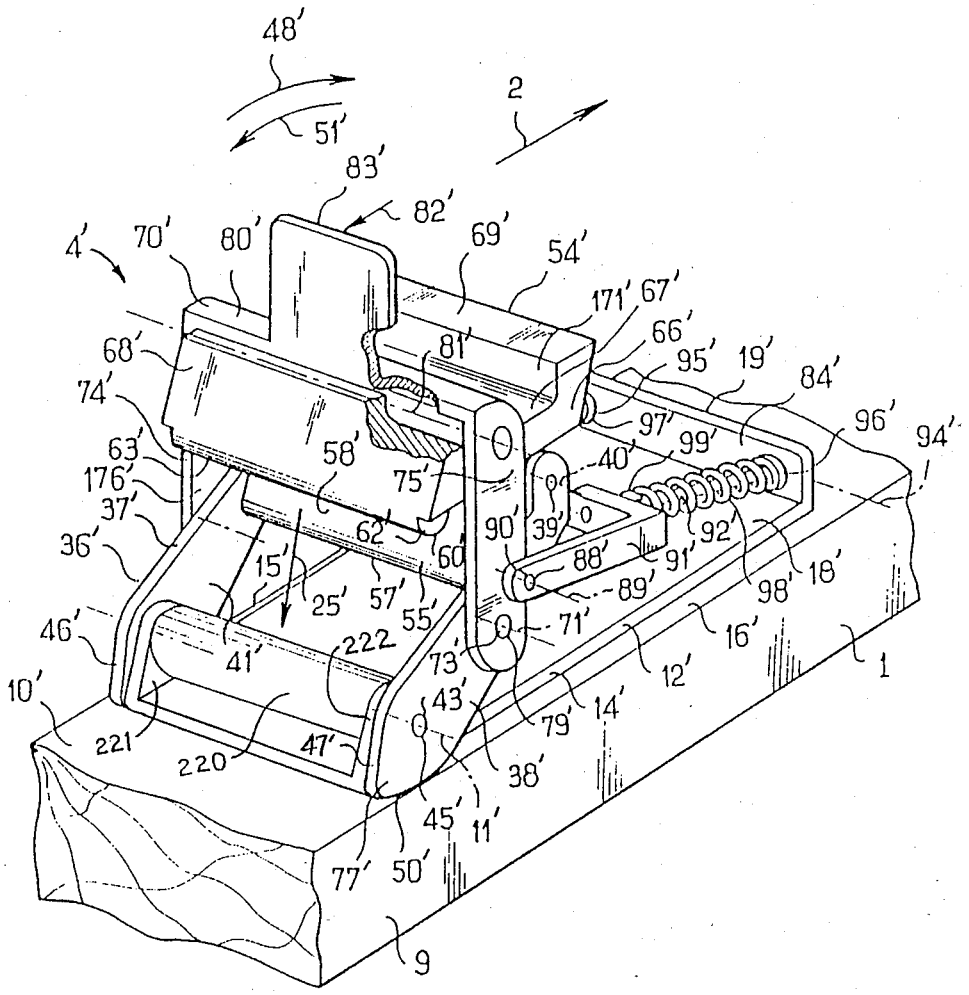
FIG. 11*a* illustrates, in a view similar to that of FIG. 11, an alternate form of the support element of the second embodiment of the present invention.

Towards the rear, in the position illustrated in FIGS. 9 and 11, the front beak 55' of latching element 54' is defined by a substantially planar and substantially vertical surface 58' which, in the position illustrated in FIG. 12, is oriented substantially horizontally. Toward the front in the position illustrated in FIGS. 9 and 11, front beak 55' is defined by a front surface 59' whose shape is of no particular consequence as long as it does not interfere with the various movements which have been described and which will be described.

To the rear of front beak 55' and axis 40', with regard to the position illustrated in FIGS. 9 and 11, the latching element 54' has affixed thereto a rear beak 60' spaced from the rear surface 58'. Rear beak 60', has a surface 63' which is convex towards the bottom, in the position illustrated in FIGS. 9 and 11, located between two substantially planar surfaces 61' and 62' corresponding to coplanar extensions of the two surfaces such as 56' of front beak 55'. More precisely, surface 63' has, in the example illustrated, a semi-cylindrical shape centered on an axis substantially perpendicular to longitudinal median plane 3. Surface 63' constitutes a support surface of the latching element 54' in the direction 25', as well as in a direction of rotation of latching element 54' around axis 40' of the front end portion 6 of boot 5 in the position illustrated in FIG. 12 to ensure attachment thereof. In a complementary fashion, acting as a support for surface 63', the front end portion 6 of boot 5 has on its top, between surfaces 34' and 35', a rectilinear groove 64' which is adapted to be substantially perpendicular to the longitudinal median plane 3 of ski 1. Groove 64' is defined by a partially cylindrical surface 65' with a diameter substantially identical to that of surface 63' but with an angular extent less than that of surface 63'.

The vertical extension of rear beak 60', as shown in FIGS. 9 and 11, is less than that of the front beak 55' and is such that, on the one hand, it does not interfere with the pivoting movements of latching element 54' with respect to linkage element 36' previously described, and on the other hand, it applies through surface 63', to surface 65' of upper groove 64' of front end portion 6 of boot 5, a force which is oriented in direction 25' and is adapted to strongly press surface 27' of lower groove 26' of front end portion 6 of boot 5 towards axis 11' against surface 24' of rear projection 20' of plate 12', in the attachment position illustrated in FIGS. 9, 11, and 13.

Above the two beaks 55' and 60', with reference to FIGS. 9 and 11, the latching element 54' has the shape of a plate 66' which is substantially horizontal and has, in particular in this position, an upper surface 67' which is substantially planar and substantially horizontal and is bordered by a flap 68' which extends the rear beak 60' upwardly, and by a flap 69' which extends the front beak 55' upwardly. Facing respectively towards the front and towards the rear, with reference to FIGS. 9 and 11, flaps 68' and 69' have respective surfaces 170' and 171' which are substantially planar and substantially perpendicular to plane 3 and to surface 67', to which they are connected. In the position illustrated in FIG. 12, surface 67' extends substantially vertically while surfaces 70' and 71' of flaps 68' and 69' extend substantially horizontally.

In addition to latching element 54', linkage element 36' has journalled to it a stirrup 70', which will be described more particularly with reference to its position illustrated in FIGS. 9 and 11. Stirrup 70' corresponds generally to stirrup 79 of the first embodiment of FIGS. 1–7.

To this end, stirrup 70' is journalled to linkage element 36' along axis 71' which is substantially parallel to axes 11' and 40'. Axis 71' is positioned at a level between axes 11' and 40' and, further, is positioned in front of axis 11' and behind axis 40', in the position illustrated in FIGS. 9, 11, 12, and 13. As illustrated, substantially midway between these axes 11' and 40', each of wings 37' and 38' of linkage element 36' carries a respective swivel pin 72', 73', at axis 71'.

In a complementary fashion, stirrup 70' has two arms 74' and 75' which are substantially planar, elongated, substantially parallel, and symmetrical to one another with respect to the longitudinal median plane 3 of the ski. Further, they have respective facing surfaces, such as 176', which are substantially planar, substantially perpendicular to axis 71', and spaced apart by a distance corresponding to the relative spacing of surfaces 76' and 77' of wings 37' and 38' of latching element 36'. In this manner, by respective ends, the two arms 74' and 75' are in sliding contact, through their surfaces such as 176', with surfaces 76' and 77' of wings 37' and 38', respectively. At their previously noted ends, each of arms 74' and 75' carries a respective bore 78' and 79' at axis 71', to receive a respective one of swivel pins 72' and 73' to thus enable the pivotable mounting of stirrup 70' on linkage element 36' around axis 71'.

The two arms 74' and 75' have respective second ends through which they are connected by a transverse member 80', which member is substantially perpendicular to the longitudinal median plane 3 of ski 1. Between transverse member 80' and bores 78' and 79', arms 74' and 75' are likewise rigidly connected by a rectilinear reinforcement pin 81' which is likewise substantially perpendicular to the longitudinal median plane 3 of ski 1.

The distance between reinforcement pin 81' and 71', the shape of arms 74' and 75' of stirrup 70', and the configuration of upper surface 67' of latching element 54' are such that stirrup 70' can, in particular, occupy the position illustrated in FIGS. 9, 11, 12, and 13 in which stirrup 70' is supported by reinforcement pin 81' on upper surface 67' of latching element 54'. During the attachment position of the front end portion 6 of boot 5, stirrup 70' is supported in the vicinity of surface 171' of flap 69' such that stirrup 70' thus maintains the latching element 54' resting through its surface 63' of beak 60' in groove 65' of front end portion 6 of boot 5, itself nested and positioned above axis 11', through its groove 26', on projection 20' of plate 12'. To this end, the distance between reinforcement pin 81' and axis 71' is greater than the distance between axis 71' and the upper surface 67' of latching element 54' when latching element 54' occupies the attachment position illustrated in FIGS. 9, 11, and 13, but the distance between the reinforcement pin 81' and axis 71' and the portion of upper surface 67' of latching element 54' which is immediately adjacent the rear surface 170' of flap 68'. Thus, in the position illustrated in FIGS. 9 and 11, the upper surface 67' of latching element 54' slightly ascends towards the rear with reference to direction 2. A geometric plane passing through reinforcement pin 81' and axis 71' is substantially vertical, although this example is in no way limiting.

The distance between reinforcement pin 81' and axis 71' and the shape of arms 74' and 75' of stirrup 70', as well as the upper surface 67' of latching element 54' are, furthermore, such that, by rotation of stirrup 70' around axis 71' by applying a force in a forward direction 82', and by rotation of latching element 54' likewise in the forward direction, stirrup 70' and latching element 54' can be brought to the position illustrated in FIG. 12. In this position, stirrup 54' rests through reinforcement pin 81' against surface 171' of flap 69' of latching element 54', and latching element 54' abuts, via substantially planar facets 86' of plate 66', against planar facets 85' of side edges 46' and 47' of wings 37', 38' of linkage element 36'. Facets 86' are rotated forwardly from the substantially horizontal position illustrated in FIGS. 9 and 11 to the substantially vertical position illustrated in FIG. 12, where they are positioned forwardly of, e.g., surface 56' of beak 55'.

Movement in direction 82' can be caused at will, by manual action on stirrup 70', for example by the force of a ski pole applied in direction 82' on a flap 83' of transverse member 80'.

Stirrup 70' is furthermore elastically biased by means of energization assembly 84' which is substantially the same as energization assembly 101 of the first embodiment of FIGS. 1–8. Energization assembly 84' is schematically shown in FIGS. 9, 12, 13, and partially illustrated in perspective in FIGS. 11 and **11*a***.

Energization assembly 84' is pivotably connected to the stirrup 70' at arms 74' and 75', by two swivel pins 87' and 88' along axis 89'. Axis 89' is substantially parallel to, positioned above, and forward of axis 71' in the position illustrated in FIGS. 9 and 11, as well as in the position illustrated in FIG. 13 in which stirrup 70' and latching element 54' occupy the same positions as in FIG. 9 with respect to linkage element 36'. On the other hand, axis 89' is positioned at an intermediate level between axes 71' and 11', in front of axis 71', in the position illustrated in FIG. 13.

Each of swivel pins 87' and 88' is mounted for relative rotation around axis 89', in a coaxial and respective complementary bore such as 90', provided in a respective U-shaped connector 91'. Each connector 91' has attached thereto a respective rectilinear connecting rod 92' having an axis 93', substantially radial with respect to axis 89'.

Each of the connecting rods 92' thus forms a longitudinal projection towards the front with respect to respective corresponding arms 74' and 75' of stirrup 70', preferably by descending towards the front as is illustrated. Alternatively, in a manner not shown, connecting rods 92' can be positioned substantially horizontally during operation of binding 4'.

To retain the connecting rods such as 92' in the preferred orientation, the front projection 19' of plate 12' has, in a manner not shown but described with regard to the first embodiment of FIGS. 1–8, a guidance assembly allowing for a longitudinal sliding of the two connecting rods 92' with respect to plate 12' and to the ski 1, while nevertheless allowing for the rotation with respect to plate 12' and to the ski 1 around an axis 94' which is substantially parallel to axis 11' and affixed, or at least substantially affixed, with respect to plate 12' and ski 1.

Projection 19' furthermore serves as a support towards the front, with respect to plate 12', for respective front end portions 95' and 96' of helicoidal springs 97' and 98' each of which is positioned coaxially around, respectively, one of the connecting rods 92'. Each of springs 97' and 98', furthermore, has a rear end 99' resting at the rear against a respectively corresponding connector 91', in permanent compressional stress between projection 19' and respective connector 91'.

The operation of the binding 4' of the second embodiment of the invention is as follows. With the binding attached to the boot 5 as illustrated in FIGS. 9 and 11, i.e., in a position in which stirrup 70' rests via its reinforcement pin 81' on upper surface 67' of linkage element 54' and in which linkage element 36' rests via respective lower surfaces 49' and 50' of side edges 46' and 47' of wings 37' and 38', on the strips 15' and 16' of upper surface 10' of ski 1, the binding 4' is in a stable state, by virtue of the action of springs 97' and 98' on stirrup 70'.

Starting from this position, if the linkage element 36' is pivoted in direction 48', springs 97' and 98', whose compression increases, retain stirrup 70' and latching element 54' in the position shown in FIGS. 9 and 11 with respect to linkage element 36', as is seen in FIG. 12, wherein the heel (not shown) of boot 5 has been lifted from the surface of ski 1 which, of course, occurs in the course of cross-country skiing. In the position of FIG. 13, springs 97' and 98' apply to linkage element 54' a return moment in direction 51', towards the position illustrated in FIGS. 9 and 11. The front end portion 6 of boot 5, the linkage element 36', stirrup 70' and latching element 54' act as though they are affixed to one another, turning around axis 11 with respect to plate 12' and with respect to ski 1, to exert an elastic return effect towards the position illustrated in FIGS. 9 and 11.

During such rotational movement, axes 93' of the connecting rods 91', which are substantially radial with respect to axes 89' and 94', pass above axes 11' and 71', i.e., this configuration is maintained in the limit pivoting position of linkage element 36' in direction 48', illustrated in FIG. 13 and determined by the arrival of the junction of surfaces 27' and 31' of groove 26' of front end portion 6 of boot 5 to the junction of surfaces 24' and 21' of projection 20' of plate 12' and/or by abutment means not shown.

Starting from the position illustrated in FIGS. 9 and 11, if a force is applied to stirrup 70' in direction 82' against plate 83', which tends to cause stirrup 70' to pivot forwardly around axis 71' with respect to linkage element 36', which is immovable with respect to plate 12' and ski 1, the pivoting of stirrup 70' is translated into an increased compression of springs 97' and 98'. Springs 97' and 98', of course, are biased to bring stirrup 70' into the position illustrated in FIGS. 9 and 11 and act along axis 93' of the connecting rods 92' positioned above axis 71'.

On the other hand, as soon as axes 93' of the connecting rods 92' pass below axis 71', the energization assembly 84' elastically biases stirrup 70 towards the position illustrated in FIG. 12, causing movement of latching element 54' towards the position which is likewise illustrated in FIG. 12. In the FIG. 12 position of binding 4', reinforcement pin 81' of stirrup 70' leaves its support towards the rear and bottom of surface 67' of latching element 54' and comes to rest towards the front and bottom against surface 171' of flap 69' of the latching element 54'. The position illustrated in FIG. 12 constitutes a stable position by virtue of the support of facets 86' of plate 66' of latching element 54' against respective facets 85' of sides 46' and 47' of wings 37' and 38' of linkage element 36'.

During insertion of boot 5 into binding 4', a force is applied to either stirrup 70', or to latching element 54' in a direction opposite to 82', for example by means of a downward force from surface 31' of front portion 6 of boot 5 against rear surface 58' of front beak 54', near the end 57' thereof, which causes the return of binding 4' to the position illustrated in FIGS. 9 and 11. In this position, the front end portion 6 of boot 5 is locked between latching element 54' and rear projection 20' of plate 12', first against the action of energization assembly 84' and then, with the aid of energization assembly 84', by an over-center effect during crossing of axis 71' by respective axes 93' of connecting rods 92'.

One of ordinary skill in the art will readily understand that the embodiments of the binding thus described constitute a "step-in" binding, i.e., one whose operation is automatic by means of the insertion of the boot by a simple downward displacement of the boot against the ski, it being understood that it would not be beyond the scope of the present invention to modify the binding such that only the positions illustrated in FIG. 1, regarding the first embodiment, and in the position illustrated in FIGS. 9 and 11, regarding the second embodiment, constitute stable positions. In particular, the energization assemblies 101 and 84' could be modified from what has been described without going beyond the scope of the present invention.

In a general manner, the bindings described are susceptible to numerous variations without going beyond the scope of the invention.

Finally, although the invention has been described with reference to particular means, materials and embodiments, it is to be understood that the invention is not limited to the particulars disclosed and extends to all equivalents within the scope of the claims.

What is claimed is:

1. A ski binding, adapted to ensure the linkage between a cross-country ski boot and a cross-country ski, said ski binding comprising:

at least one support element;

a linkage element for linking a front end portion of said boot with said support element, said linkage element being swivel-mounted on said support element, around a first axis;

abutment means for limiting the rotation of said linkage element in a first direction around said first axis with respect to said support element, in a manner so as to define a preferred angular position of said linkage element with respect to said support element, said first direction being oriented from front to rear above said first axis;

a latching element for connecting said front end portion of said boot with said linkage element, said latching element being swivel-mounted on said linkage element around a second axis, between two respective attachment and release positions of said front end portions of said boot with respect to said linkage element, movement from said release position to said attachment position occurring by rotation of said latching element in a second direction, around a second axis with respect to said linkage element, said second direction being oriented from front to rear above said second axis;

elastic biasing means, comprising means for directly biasing said latching element in said second direction and for indirectly biasing, by means for said latching element, said linkage element in said first direction;

said elastic biasing means further comprising:

(i) a stirrup which is swivel-mounted on said linkage element around a third axis between a first limiting position in which said stirrup engages a first portion of said latching element when said latching element is in said release position, whereby said stirrup moves from said second limiting position to said first limiting position in a third direction oriented from front to rear above said third axis while said latching element moves in said second direction, and whereby said stirrup moves from said first limiting position to said second limiting position in a direction opposite to said third direction, while said latching element moves in a direction opposite to said direction; and (ii) means for elastically biasing said stirrup in said third direction, toward said first limiting position.

2. A ski binding according to claim 1, wherein said means for elastically biasing said stirrup further elastically biases said stirrup into said direction opposite to said third direction, toward said second limiting position of said stirrup.

3. A ski binding according to claim 2, wherein said latching element further comprises a portion biased in said second direction by said front portion of said boot when said latching element is in said release position.

4. A ski binding according to claim 1, wherein said means for elastically biasing said stirrup comprises at least one connecting rod journalled on said stirrup around a fourth axis, means for guiding said at least one connecting rod, with respect to said support element, in a longitudinal direction and in rotation around a fifth axis, and an elastic biasing element associated with said at least one connecting rod for biasing said at least one connecting rod in said longitudinal direction with respect to said support element.

5. A ski binding according to claim 2, wherein said means for elastically biasing said stirrup comprises at least one connecting rod journalled on said stirrup around a fourth axis, means for guiding said at least one connecting rod, with respect to said support element, in a longitudinal direction and in rotation around a fifth axis, and an elastic biasing element associated with said at least one connecting rod for biasing said at least one connecting rod in said longitudinal direction with respect to said support element, and wherein said fourth axis is positioned relative to said fifth axis and said third axis such that the distance between said third axis and said fifth axis is greater than the distance from said fourth axis to either of said third axis or said fifth axis.

6. A ski binding according to claim 4, wherein, with said ski in a horizontal position, said fourth axis is always positioned above said first axis and, at least in said first limiting position of said stirrup, above said third axis.

7. A ski binding according to claim 5, wherein, with said ski in a horizontal position, said third axis is always positioned above said first axis and wherein said fourth axis is positioned between said first axis and said third axis, at least in said second limiting position of said stirrup.

8. A cross-country ski binding for securing a front portion of a boot on a ski comprising:

(a) a linkage element journalled for rotation around a first axis, said first axis adapted to be fixed relative to a ski;

(b) a latching element journalled for rotation on said linkage element around a second axis between an attachment position in which a front portion of a ski boot is latched to said binding by said latching element, and a release position in which said ski boot is not latched to said binding;

(c) a stirrup element journalled for rotation on said linkage element around a third axis for engagement with said latching element at least (i) in a first limiting position of said stirrup when said latching element is in said attachment position and (ii) in a second position of said stirrup element when said latching element is in said release position; and (d) means for urging said latching element toward said attachment position and for urging said stirrup element toward said first limiting position, said means for urging having a first portion adapted to be operatively associated with said ski and a second portion operatively associated with said stirrup in a direction to thereby urge said latching element toward said attachment position.

9. A ski binding according to claim 8, wherein said means for urging is operatively associated with said stirrup to bias said stirrup for rotation around said third axis.

10. A ski binding according to claim 8, wherein said means for urging is further operatively associated with said stirrup to bias said stirrup in a direction to thereby urge said latching element toward said release position.

11. A ski binding according to claim 10, wherein said means for urging is operatively associated with said stirrup for rotation around said third axis.

12. A ski binding according to claim 8, wherein said second portion of said means for urging is journalled to said stirrup around a fourth axis.

13. A ski binding according to claim 12, said third axis is adapted to be spaced from a top surface of said ski by a predetermined distance, and whereby in said attachment position said fourth axis is adapted to be spaced from said top surface by a distance greater than said predetermined distance.

14. A ski binding according to claim 13, whereby in said release position, said fourth axis is adapted to be spaced from said top surface by a distance less than said predetermined distance.

15. A ski binding according to claim 8, wherein said latching element further comprises a surface which is engaged by a segment of said stirrup element when said latching element is in said attachment position, wherein said surface comprises a first portion and a second portion and wherein, when said latching element is in said attachment position, the distance between said segment of said stirrup element and said third axis is greater than the distance between said first portion of said surface and said third axis, but is less than the distance between said second portion of said surface and said third axis.

16. A ski binding according to claim 15, wherein, when said latching element is in said attachment position, said first portion of said surface of said latching element is adapted to be spaced from a top surface of said ski by a distance less than the distance between said second portion of said surface of said latching element.

17. A ski binding according to claim 8, wherein said latching element further comprises a beak adapted to be engaged by said front portion of said ski boot, which engagement rotates said latching element toward said attachment position.

18. A ski binding according to claim 8, wherein said latching element further comprises a projection, said stirrup element further comprises a segment adapted to engage said projection as said latching element moves from said attachment position to said release position.

19. A ski binding according to claim 18, wherein said stirrup element further comprises a flap adapted to be manually engaged to thereby effect engagement of said segment with said projection to thereby move said latching element to said release position.

20. A ski binding according to claim 19, wherein said projection is shaped in a manner such that said segment is retained by said latching element as said latching element is moved between said attachment position and said release position.

21. A ski binding according to claim 8, wherein said linkage element further comprises at least one abutment adapted to limit said rotation of said linkage element in a direction toward the rear of said ski.

22. A ski binding according to claim 21, wherein said at least one abutment further comprises at least a second abutment adapted to limit rotation of said linkage element in a direction toward the front of said ski.

23. A ski binding according to claim 8, wherein said latching element further comprises at least one facet which engages at least one respective surface of said linkage element in said release position.

24. A ski binding according to claim 8, further comprising a support element adapted to be affixed to said ski, wherein said linkage element is journalled on said support element around said first axis.

25. A ski binding according to claim 24, wherein said support element further comprises a generally inverted U-shape in transverse cross-section and is adapted to overlie a central longitudinal rib of said ski.

26. A ski binding according to claim 25, wherein said support element further comprises a pair of substantially parallel lateral sides, wherein said first axis intersects each of said sides, wherein said linkage element further comprises a pair of wings, whereby said wings are in sliding contact with said pair of sides.

27. A ski binding according to claim 8, wherein said linkage element further comprises a tongue which extends in a direction away from an upper surface of said ski and is adapted to receive an attachment element projecting from said front portion of said ski boot.

28. A ski binding according to claim 27, wherein said tongue further comprises a first substantially planar surface and at least one projection offset therefrom which is adapted to engage said attachment element of said ski boot.

29. A ski binding according to claim 28, wherein said tongue further comprises a second substantially planar downwardly facing inclined surface adapted to engage a complementary upwardly facing inclined surface on said front portion of said ski boot.

30. A ski binding according to claim 29, wherein said linkage element further comprises a substantially planar upwardly facing inclined surface adapted to engage a complementary downwardly facing inclined surface on said front portion of said ski boot.

31. A ski binding according to claim 24, wherein said support element further comprises a least one substantially flat lower surface adapted to be affixed to the top surface of said ski.

32. A ski binding according to claim 31, wherein said support element further comprises at least a first projection to which said linkage element is journalled around said first axis.

33. A ski binding according to claim 32, wherein said support element further comprises a second projection to which said first portion of said means for urging is journalled for rotation.

34. A ski binding according to claim 32, wherein said first projection comprises a journal surface, adapted to engage a complementarily shaped surface of said front portion of said ski boot.

35. A ski binding according to claim 34, wherein said complementarily shaped surface of said front portion of said boot has a predetermined axis of curvature and wherein, in said attachment position of said latching element, said first axis is adapted to substantially coincide with said axis of curvature so that, at least during said attachment position, said linkage element and said boot both rotate simultaneously around said first axis and said axis of curvature.

36. A ski binding according to claim 32, further comprising at least a first roller journalled around said first axis and affixed to said first projection, adapted to engage a complementarily shaped surface of said front portion of said ski boot to thereby permit said ski boot and said linkage element, at least during said attachment position of said latching element, to both rotate about said first axis.

37. A ski binding according to claim 34, wherein said latching element comprises at least a first beak which projects in a direction such that, as said latching element rotates from said release position to said attachment position, said first beak moves in a direction to engage a respective surface of said front portion of said ski boot to thereby latch said front portion of said ski boot to said ski binding.

38. A ski binding according to claim 37, wherein, in said attachment position of said latching member, a radial force is exerted through said first beak with respect to said first axis.

39. A ski binding according to claim 37, wherein said latching element comprises a second beak which projects in a direction such that it is adapted to be engaged by said front portion of said ski boot, which engagement rotates said latching element around said second axis toward said attachment position.

40. A ski binding according to claim 8, further comprising guidance means adapted to be affixed to said ski and operatively associated with said first portion of said means for urging.

41. A ski binding according to claim 40, wherein said means for urging further comprises at least one connecting member, wherein said first portion and said second portion of said means for urging comprise, respectively, a first portion of said connecting member and a second portion of said connecting member, and wherein said guidance means is adapted to be operatively associated with said first portion of said connecting member.

42. A ski binding according to claim 44, wherein said guidance means further comprises means to permit said at least one connecting member to move horizontally relative to said guidance means.

43. A ski binding according to claim 42, wherein said guidance means further comprises means to permit said at least one connecting member to rotate relative to said guidance means.

* * * * *

UNITED STATES PATENT AND TRADEMARK OFFICE
CERTIFICATE OF CORRECTION

PATENT NO. : 4,909,532

DATED : March 20, 1990

INVENTOR(S) : M. PROVENCE et al.

It is certified that error appears in the above-identified patent and that said Letters Patent is hereby corrected as shown below:

At column 6, line 13, after "element" insert ---.---.

At column 6, line 28, change "stirrups" to ---stirrup---.

At column 7, line 42, change "invention present" to ---present invention---.

At column 12, line 29, after "1" insert ---.---.

At column 13, line 19, after "along" insert ---an---.

At column 13, line 62, change "it it" to ---it---.

At column 16, line 3, change "elements" to ---element---.

At column 17, line 56, change "24" to ---13---.

At column 18, line 31, change "12" to ---12'---.

At column 18, line 68, change "11" to ---11'---.

At column 20, line 27, after "1" insert ---.---.

At column 20, line 36, change "16" to ---16'---.

At column 21, line 22, change "48'" to ---47'---.

At column 22, line 16, before "41'" insert ---surfaces---.

At column 24, line 1, before "71'" insert ---axis---.

At column 24, line 12, change "65'" to ---64'---.

At column 24, line 20, after "71'" insert ---is less than the distance between axis 71'---.

At column 25, line 59, change "11" to ---11'---.

At column 26, line 17, change "70" to ---70'---.

At column 26, line 32, before "82'" insert ---direction---.

At column 26, line 34, change "54'" to ---55'---.

At column 27, line 45 (claim 1, line 45), after "said" insert ---second---.

UNITED STATES PATENT AND TRADEMARK OFFICE

CERTIFICATE OF CORRECTION

PATENT NO. : 4,909,532

DATED : March 20, 1990

INVENTOR(S) : M. PROVENCE et al.

It is certified that error appears in the above-identified patent and that said Letters Patent is hereby corrected as shown below:

At column 32, line 5, (claim 42, line 1), "44" should be ---41---.

Signed and Sealed this

Thirtieth Day of June, 1992

*Attest:*

DOUGLAS B. COMER

*Attesting Officer*

*Acting Commissioner of Patents and Trademarks*